US008613284B2

(12) United States Patent
Hutchens

(10) Patent No.: US 8,613,284 B2
(45) **Date of Patent: *Dec. 24, 2013**

(54) CIGARETTE FILTER COMPRISING A DEGRADABLE FIBER

(75) Inventor: Ronald Keith Hutchens, East Bend, NC (US)

(73) Assignee: R.J. Reynolds Tobacco Company, Winston-Salem, NC (US)

( * ) Notice: Subject to any disclaimer, the term of this patent is extended or adjusted under 35 U.S.C. 154(b) by 1034 days.

This patent is subject to a terminal disclaimer.

(21) Appl. No.: 12/392,725

(22) Filed: Feb. 25, 2009

(65) Prior Publication Data

US 2009/0288669 A1 Nov. 26, 2009

Related U.S. Application Data

(63) Continuation-in-part of application No. 12/124,874, filed on May 21, 2008.

(51) Int. Cl.
*A24D 3/06* (2006.01)

(52) U.S. Cl.
USPC ..... 131/341; 131/202; 131/331

(58) Field of Classification Search
USPC ..... 131/202, 331, 203, 341
See application file for complete search history.

(56) References Cited

U.S. PATENT DOCUMENTS

| | | | | |
|---|---|---|---|---|
| 2,881,770 | A | | 4/1959 | Touey |
| 3,101,723 | A | | 8/1963 | Seligman et al. |
| 3,217,715 | A | | 11/1965 | Berger et al. |
| 3,236,244 | A | | 2/1966 | Irby, Jr. et al. |
| 3,266,973 | A | * | 8/1966 | Crowley ..... 162/164.2 |
| 3,311,519 | A | | 3/1967 | Touey et al. |
| 3,319,629 | A | | 5/1967 | Chamberlain |
| 3,347,247 | A | | 10/1967 | Lloyd |
| 3,349,780 | A | | 10/1967 | Sublett et al. |
| 3,370,595 | A | | 2/1968 | Davis et al. |
| 3,413,982 | A | | 12/1968 | Sublett et al. |
| 3,602,231 | A | | 8/1971 | Dock |
| 3,648,711 | A | | 3/1972 | Berger et al. |
| 3,904,577 | A | | 9/1975 | Buisson |
| 3,957,563 | A | | 5/1976 | Sexstone |
| 3,972,335 | A | | 8/1976 | Tiggelbeck et al. |

(Continued)

FOREIGN PATENT DOCUMENTS

| | | | |
|---|---|---|---|
| BE | 1 007 973 | A7 | 11/1995 |
| DE | 10 2006 025 738 | B3 | 11/2007 |

(Continued)

OTHER PUBLICATIONS www.merriam-webster.com dictionary definition of "embed" and insert, printed from the Internet on Apr. 9, 2012.*

(Continued)

*Primary Examiner* — Richard Crispino
*Assistant Examiner* — Dionne Walls Mayes
(74) *Attorney, Agent, or Firm* — Womble Carlyle Sandridge & Rice, LLP

(57) ABSTRACT

A cigarette filter is provided that includes at least one filter segment having at least one biodegradable fiber imbedded therein, the biodegradable fiber optionally carrying an additive capable of altering the flavor or aroma of mainstream smoke, such as an adsorbent material, a flavorant, or a deodorizing agent. Smoking articles incorporating such a cigarette filter are also provided.

19 Claims, 6 Drawing Sheets

(56) References Cited

U.S. PATENT DOCUMENTS

| | | | | |
|---|---|---|---|---|
| 4,019,521 | A | 4/1977 | Briskin | |
| 4,020,850 | A | 5/1977 | Cogbill, II | |
| 4,119,104 | A | 10/1978 | Roth | |
| 4,174,720 | A | 11/1979 | Hall | |
| 4,195,649 | A | 4/1980 | Noguchi et al. | |
| 4,201,234 | A | 5/1980 | Neukomm | |
| 4,223,597 | A | 9/1980 | Lebet | |
| 4,253,476 | A | 3/1981 | Sato | |
| 4,281,671 | A * | 8/1981 | Bynre et al. | 131/335 |
| 4,306,578 | A | 12/1981 | Schmidt et al. | |
| 4,331,166 | A | 5/1982 | Hale | |
| 4,379,465 | A * | 4/1983 | Coq | 131/332 |
| 4,771,795 | A | 9/1988 | White et al. | |
| 4,821,749 | A | 4/1989 | Toft et al. | |
| 4,862,905 | A | 9/1989 | Green, Jr. et al. | |
| 4,876,078 | A | 10/1989 | Arakawa et al. | |
| 4,947,874 | A | 8/1990 | Brooks et al. | |
| 5,012,828 | A | 5/1991 | Hayes et al. | |
| 5,025,814 | A | 6/1991 | Raker | |
| 5,027,837 | A | 7/1991 | Clearman et al. | |
| 5,060,676 | A | 10/1991 | Hearn et al. | |
| 5,076,297 | A | 12/1991 | Farrier et al. | |
| 5,137,034 | A | 8/1992 | Perfetti et al. | |
| 5,230,960 | A | 7/1993 | Iizuka | |
| 5,268,158 | A | 12/1993 | Paul, Jr. | |
| 5,338,605 | A | 8/1994 | Noland et al. | |
| 5,360,023 | A | 11/1994 | Blakley et al. | |
| 5,446,005 | A | 8/1995 | Endo | |
| 5,482,773 | A | 1/1996 | Bair | |
| 5,536,486 | A | 7/1996 | Nagata et al. | |
| 5,568,819 | A | 10/1996 | Gentry et al. | |
| 5,622,190 | A | 4/1997 | Arterbery et al. | |
| 5,690,126 | A * | 11/1997 | Matsumura et al. | 131/343 |
| 5,911,224 | A | 6/1999 | Berger | |
| 6,537,186 | B1 | 3/2003 | Veluz | |
| 6,571,802 | B1 | 6/2003 | Yamashita | |
| 6,584,979 | B2 | 7/2003 | Xue et al. | |
| 6,631,722 | B2 | 10/2003 | MacAdam et al. | |
| 6,739,344 | B2 | 5/2004 | Yamashita | |
| 6,761,174 | B2 | 7/2004 | Jupe et al. | |
| 6,789,547 | B1 | 9/2004 | Paine, III | |
| 6,789,548 | B2 | 9/2004 | Bereman | |
| 7,049,382 | B2 | 5/2006 | Haftka et al. | |
| 7,074,170 | B2 | 7/2006 | Lanier, Jr. et al. | |
| 7,223,376 | B2 | 5/2007 | Panter et al. | |
| 7,240,678 | B2 | 7/2007 | Crooks et al. | |
| 7,370,657 | B2 | 5/2008 | Zhuang et al. | |
| 2002/0020420 | A1 | 2/2002 | Xue et al. | |
| 2002/0166563 | A1 | 11/2002 | Jupe et al. | |
| 2003/0154993 | A1 | 8/2003 | Paine, III et al. | |
| 2003/0168070 | A1 | 9/2003 | Xue et al. | |
| 2003/0200973 | A1 | 10/2003 | Xue et al. | |
| 2003/0213496 | A1 * | 11/2003 | Wolff et al. | 131/341 |
| 2004/0194792 | A1 | 10/2004 | Zhuang et al. | |
| 2004/0226569 | A1 | 11/2004 | Yang et al. | |
| 2004/0237984 | A1 | 12/2004 | Figlar et al. | |
| 2005/0049128 | A1 | 3/2005 | Buhl et al. | |
| 2005/0066984 | A1 | 3/2005 | Crooks et al. | |
| 2005/0133051 | A1 | 6/2005 | Luan et al. | |
| 2006/0144410 | A1 | 7/2006 | Luan et al. | |
| 2006/0180164 | A1 | 8/2006 | Paine, III et al. | |
| 2006/0201524 | A1 | 9/2006 | Zhang et al. | |
| 2006/0231113 | A1 | 10/2006 | Newbery et al. | |
| 2007/0056600 | A1 | 3/2007 | Coleman, III et al. | |
| 2007/0068540 | A1 | 3/2007 | Thomas et al. | |
| 2008/0029112 | A1 | 2/2008 | McHugh et al. | |
| 2008/0029118 | A1 | 2/2008 | Nelson et al. | |
| 2008/0092912 | A1 | 4/2008 | Robinson et al. | |
| 2008/0168997 | A1 * | 7/2008 | Wu et al. | 131/331 |
| 2008/0190439 | A1 | 8/2008 | Veluz et al. | |
| 2008/0230079 | A1 | 9/2008 | Besso et al. | |
| 2008/0245376 | A1 | 10/2008 | Travers et al. | |
| 2008/0302373 | A1 | 12/2008 | Stokes et al. | |
| 2009/0032037 | A1 | 2/2009 | Xue et al. | |

FOREIGN PATENT DOCUMENTS

| | | | |
|---|---|---|---|
| EP | 0 419 733 | A2 | 4/1991 |
| EP | 0 419 981 | A2 | 4/1991 |
| EP | 0 579 410 | A1 | 1/1994 |
| EP | 0 913 100 | A2 | 5/1999 |
| GB | 1 308 885 | | 3/1973 |
| WO | WO 2005/023026 | A1 | 3/2005 |
| WO | WO 2006/051422 | A1 | 5/2006 |
| WO | WO 2006/064371 | A1 | 6/2006 |
| WO | WO 2006/103404 | A1 | 10/2006 |
| WO | WO 2007/085830 | A2 | 8/2007 |
| WO | WO 2007/104908 | A1 | 9/2007 |
| WO | WO 2008/043982 | A2 | 4/2008 |

OTHER PUBLICATIONS

United States Department of Defense, "Polyacrylonitrile (PAN) Carbon Fibers Industrial Capability Assessment, OUSD(AT&L) Industrial Policy", Oct. 2005, pp. 1-17, http://www.acq.osd.mil/ip/docs/pan_carbon_fiber_report_to_congress_10-2005.pdf.

* cited by examiner

CIGARETTE FILTER COMPRISING A DEGRADABLE FIBER

CROSS-REFERENCE TO RELATED APPLICATIONS

The present application is a continuation-in-part application of U.S. application Ser. No. 12/124,874, filed May 21, 2008, the contents of which are herein incorporated by reference in their entirety.

BACKGROUND OF THE INVENTION

1. Field of the Invention

Embodiments of the present invention relate to the formation of tobacco products, such as smoking articles (e.g., cigarettes), and more particularly, to apparatuses and associated methods for inserting an adsorbent material into a cigarette filter.

2. Description of Related Art

Popular smoking articles, such as cigarettes, have a substantially cylindrical rod shaped structure and include a charge, roll or column of smokable material, such as shredded tobacco (e.g., in cut filler form), surrounded by a paper wrapper, thereby forming a so-called "smokable rod" or "tobacco rod." Normally, a cigarette has a cylindrical filter element aligned in an end-to-end relationship with the tobacco rod. Typically, a filter element comprises plasticized cellulose acetate tow circumscribed by a paper material known as "plug wrap." Certain filter elements can incorporate polyhydric alcohols. Typically, the filter element is attached to one end of the tobacco rod using a circumscribing wrapping material known as "tipping paper." Descriptions of cigarettes and the various components thereof are set forth in Tobacco Production, Chemistry and Technology, Davis et al. (Eds.) (1999). A cigarette is employed by a smoker by lighting one end thereof and burning the tobacco rod. The smoker then receives mainstream smoke into his/her mouth by drawing on the opposite end (e.g., the filter end) of the cigarette.

Certain cigarettes incorporate filter elements having adsorbent materials dispersed therein, such as activated carbon or charcoal materials (collectively, carbonaceous materials) in particulate or granular form (i.e., powder). For example, an exemplary cigarette filter can possess multiple segments, and at least one of those segments can comprise particles of high carbon-content materials. Various types of filters incorporating charcoal particles or activated carbon types of materials are set forth in U.S. Pat. No. 2,881,770 to Touey; U.S. Pat. No. 3,101,723 to Seligman et al.; U.S. Pat. No. 3,236,244 to Irby et al.; U.S. Pat. No. 3,311,519 to Touey et al.; U.S. Pat. No. 3,347,247 to Lloyd; U.S. Pat. No. 3,349,780 to Sublett et al.; U.S. Pat. No. 3,370,595 to Davis et al.; U.S. Pat. No. 3,413,982 to Sublett et al.; U.S. Pat. No. 3,602,231 to Dock; U.S. Pat. No. 3,972,335 to Tigglebeck et al.; U.S. Pat. No. 5,360,023 to Blakley et al.; and U.S. Pat. No. 6,537,186 to Veluz; U.S. Pat. Publication No. 2007/0056600 to Coleman, III et al.; PCT WO 2006/064371 to Banerjea et al. and PCT WO 2006/051422 to Jupe et al.; which are incorporated herein by reference.

As mentioned, such carbonaceous material types are typically in the form of particles or granules when incorporated into the filter elements. For example, granules of carbonaceous material can be incorporated into "dalmation" types of filter regions using the general types of techniques used for traditional dalmation filter manufacture. Techniques for production of dalmation filters are known, and representative dalmation filters have been provided commercially by Filtrona Greensboro Inc. Alternatively, granules of carbonaceous material can be incorporated into "cavity" types of filter regions using the general types of techniques used for traditional "cavity" filter manufacture. Alternatively, other known types of techniques and equipment for producing filter segments incorporating granular materials can be suitably altered so as to introduce carbonaceous material into the filter segments. However, such techniques often are rudimentary in that the particulates or granules of carbonaceous material are roughly inserted into the filter element as either a loose powder or a slurry, a process which can be described as, for example, inconsistent, wasteful, and "messy."

As such, there exists a need for apparatuses and methods for inserting the adsorbent material into the filter segments/elements of a smoking article in a manner facilitating a cleaner and more efficient process. Such apparatuses and methods should desirably be able to insert the adsorbent material in various forms into the filter element.

SUMMARY OF THE INVENTION

The above and other needs are met by embodiments of the present invention which, according to various aspects, provide apparatuses and methods for inserting an adsorbent material carried by a carrier material into a filter rod member of a smoking article. Accordingly, one aspect relates to an apparatus for forming filter rods used in the manufacture of smoking articles, wherein each rod has an adsorbent material, carried by a carrier material, inserted into the filter rod along its length such that, when the rod is longitudinally subdivided into rod portions, each rod portion includes at least a portion of the adsorbent material. The apparatus incorporates equipment for supplying a continuous supply of filter material (e.g., a filter tow processing unit adapted to supply filter tow to a continuous rod forming unit). A representative apparatus may also include, for example, a hopper and rotating wheel arrangement such as disclosed in U.S. Patent Application Publication No. US 2007/0068540 A1 to Thomas et al. (and incorporated herein by reference), operably engaged with the filter supply equipment, for supplying the carrier material carrying the adsorbent material to the filter material. Other arrangements for inserting objects into the filter material are disclosed, for example, in U.S. Pat. No. 4,862,905 to Green, Jr. et al. (i.e., insertion of individual strand portions); U.S. Patent Application Publication No. US 2007/0068540 A1 to Thomas et al. (i.e., insertion of capsules); U.S. patent application Ser. No. 11/461,941 to Nelson et al. (i.e., insertion of continuous strands); U.S. patent application Ser. No. 11/760,983 to Stokes et al. (i.e., insertion of continuous strands); and U.S. Pat. No. 7,074,170 to Lanier, Jr. et al. (all incorporated herein by reference).

The continuous supply of filter material is formed, for example, by a rod-forming unit into a continuous cylindrical rod member. The carrier material carrying the adsorbent material is inserted by an insertion unit into the rod member. In some aspects, the continuous rod may then be subdivided at predetermined intervals by a rod-dividing unit so as to form a plurality of filter rods or rod portions or filter elements such that each rod portion includes at least a portion of the adsorbent material.

In some aspects, a method of forming a cigarette filter rod member comprises forming a continuous supply of a filter material into a continuous cylindrical rod member, and inserting an adsorbent material carried by a carrier material into the rod member such that the adsorbent material is disposed within the rod member. Such a method may further comprise dividing the rod member into a plurality of rod portions along the longitudinal axis thereof such that each rod portion includes at least a portion of the adsorbent material.

In one aspect, the invention provides a cigarette filter comprising at least one filter segment having one or more composite fiber structures imbedded therein, the composite fiber structure comprising a carrier fiber and an adsorbent fiber (e.g., a carbonaceous fiber), the adsorbent fiber comprising an adsorbent material. Exemplary carbonaceous fibers can be prepared by carbonization of a precursor fiber, such as phenolic fibers, cellulosic fibers, rayon fibers, acrylic fibers, and pitch fibers. In certain embodiments, the filter comprises one or more segments of fibrous tow material, such as cellulose acetate tow.

The composite fiber structure can comprise multiple carrier fibers or multiple adsorbent fibers. One or both of the carrier fiber and adsorbent fiber can be in the form of a yarn. The entire composite fiber structure can also be in the form of a yarn. The carrier fiber acts as a carrier for the adsorbent fiber, such as by enwrapping the adsorbent fiber around the carrier fiber.

In another aspect, the invention provides a cigarette filter comprising at least one filter segment having at least one degradable fiber imbedded therein, such as a biodegradable fiber. The fiber can be any strand, thread, or yarn that has any of a variety of cross-sections, including a circular or a flattened cross-section. The fiber can provide a visual difference or a textural/tactile difference to the filter element. The fiber itself could alter the character or nature of the smoke passing through the filter, or optionally carry an additive capable of altering the character or nature of the smoke (e.g., such as one or more adsorbent materials, flavorants, deodorizing agents, or combinations thereof). The additive can be carried by, or associated with, the degradable fiber using a variety of techniques, such as by absorption of the additive into the fiber structure, coating of the additive onto the fiber structure, adherence of a solid additive onto the surface of the fiber, or wrapping of an additive in the form of a fiber (e.g., a carbonaceous fiber) around the degradable fiber.

Exemplary biodegradable fibers include cellulosic fibers, polyvinyl alcohol, aliphatic polyesters, aliphatic polyurethanes, cis-polyisoprene, cis-polybutadiene, polyhydroxy alkanoates, polyanhydrides, and copolymers and blends thereof. In one embodiment, the biodegradable fiber is a bamboo fiber or a polylactic acid fiber.

The invention also includes smoking articles incorporating a filter element as described herein, such as a smoking article comprising a rod of smokable material circumscribed by a wrapping material, the rod of smokable material being attached to a cigarette filter according to the invention.

BRIEF DESCRIPTION OF THE DRAWINGS

In order to assist the understanding of embodiments of the invention, reference will now be made to the appended drawings, which are not necessarily drawn to scale. The drawings are exemplary only, and should not be construed as limiting the invention.

DETAILED DESCRIPTION OF THE PREFERRED EMBODIMENTS

The present inventions now will be described more fully hereinafter with reference to the accompanying drawing. The invention may be embodied in many different forms and should not be construed as limited to the embodiments set forth herein; rather, these embodiments are provided so that this disclosure will satisfy applicable legal requirements. Like numbers refer to like elements throughout. As used in this specification and the claims, the singular forms "a," "an," and "the" include plural referents unless the context clearly dictates otherwise.

Figure 1:
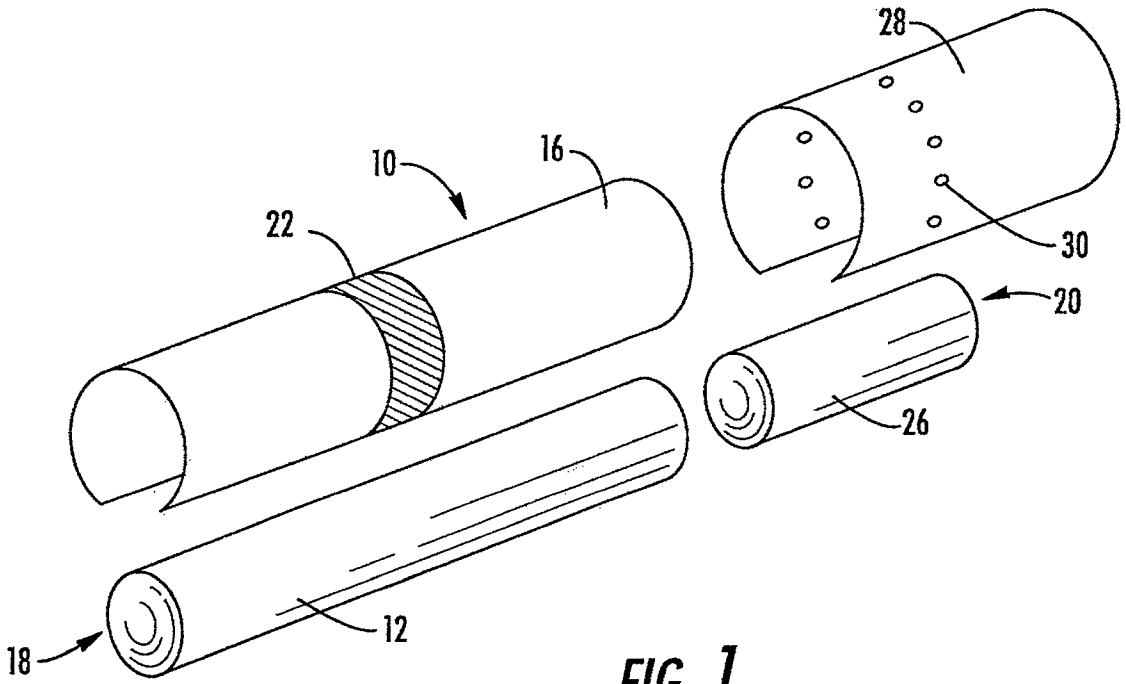
FIG. 1 is an exploded perspective view of a smoking article having the form of a cigarette, showing the smokable material, the wrapping material components, and the filter element of the cigarette.

Referring to FIG. 1, there is shown a smoking article 10 in the form of a cigarette and possessing certain representative components of a smoking article produced or formed by the present invention. The cigarette 10 includes a generally cylindrical rod 12 of a charge or roll of smokable filler material contained in a circumscribing wrapping material 16. The rod 12 is conventionally referred to as a "tobacco rod." The ends of the tobacco rod 12 are open to expose the smokable filler material. The cigarette 10 is shown as having one optional band 22 (e.g., a printed coating including a film-forming agent, such as starch, ethylcellulose, or sodium alginate) applied to the wrapping material 16, and that band circumscribes the cigarette rod in a direction transverse to the longitudinal axis of the cigarette. That is, the band 22 provides a cross-directional region relative to the longitudinal axis of the cigarette. The band 22 can be printed on the inner surface of the wrapping material (i.e., facing the smokable filler material), or less preferably, on the outer surface of the wrapping material. Although the cigarette can possess a wrapping material having one optional band, the cigarette also can possess wrapping material having further optional spaced bands numbering two, three, or more.

At one end of the tobacco rod 12 is the lighting end 18, and at the mouth end 20 is positioned a filter element 26. The filter element 26 positioned adjacent one end of the tobacco rod 12 such that the filter element and tobacco rod are axially aligned in an end-to-end relationship, preferably abutting one another. Filter element 26 may have a generally cylindrical shape, and the diameter thereof may be essentially equal to the diameter of the tobacco rod. The ends of the filter element 26 permit the passage of air and smoke therethrough.

Figure 2:
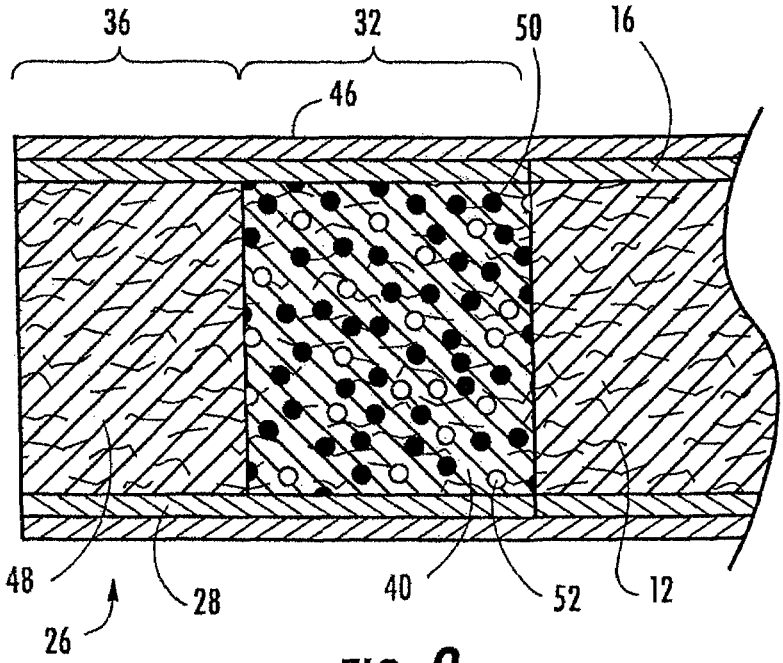
FIG. 2 is a cross-sectional view of a filter element incorporating an adsorbent material therein according to one embodiment of the present invention.
Figure 3A:
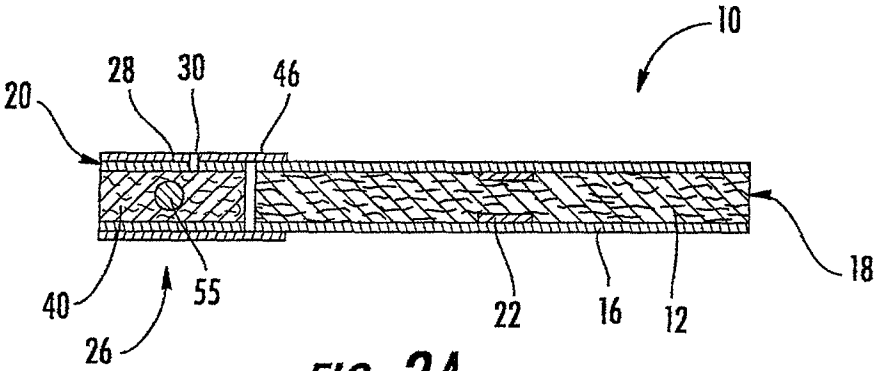
FIGS. 3A-3D are cross-sectional views of a smoking article having the form of a cigarette, showing the smokable material, the wrapping material components, and the adsorbent material-containing filter element of that cigarette.
Figure 3B:
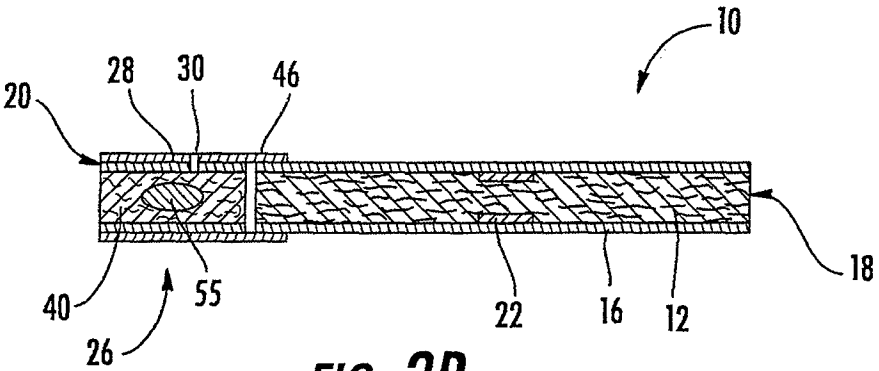
Figure 3C:
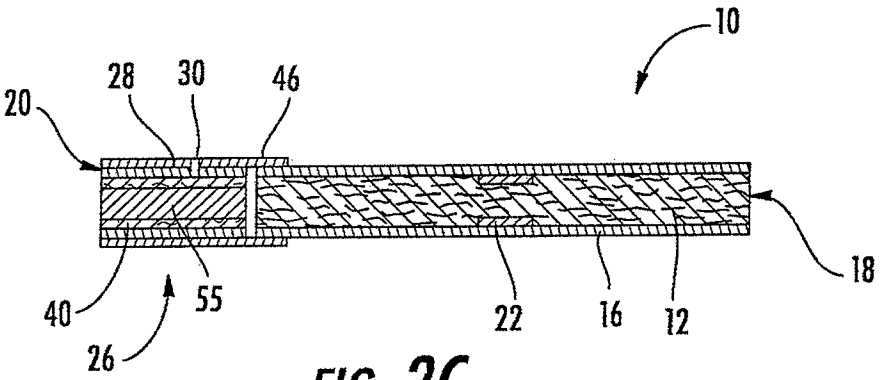
Figure 3D:
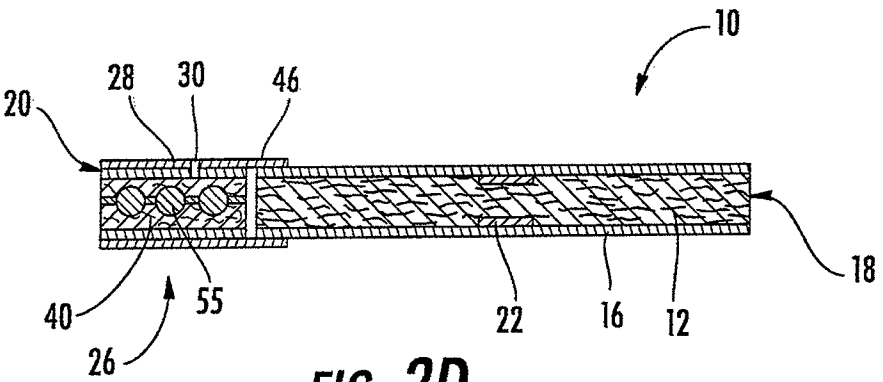

In some instances, the filter element 26 may be configured as shown in FIG. 2, wherein the filter includes a first filter segment 32 positioned adjacent one end of the tobacco rod 12. The first filter segment 32 includes filter material 40 (e.g., cellulose acetate tow impregnated with plasticizer, such as triacetin). In other instances, the filter element 26 may not be divided into segments, such as shown in FIG. 3. With continuing reference to FIG. 2, within the filter material 40 of the first segment may be inserted an adsorbent material/particulate 50. Previously, such adsorbent material 50 had been roughly inserted into the filter material 40. That is, the adsorbent material 50 had been inserted while in a loose particulate form, such as a powder or slurry. Further, within the filter material 40 of the first segment may also be optionally dispersed a plurality of particles 52 or otherwise breakable or rupturable capsules comprising a flavoring agent. In certain embodiments where a carbonaceous material is used as the adsorbent material 50, at least a portion of the carbonaceous material, and typically virtually all of the carbonaceous material, is in intimate contact with an effective amount of a mixture of polyol ester (e.g., triacetin) and polyol (e.g., propylene glycol). If desired, the filter element also can be incorporate other components that have the ability to alter the properties of the mainstream smoke that passes throughout the filter element. See, for example, U.S. Pat. Application Publication Nos. 2004/0237984 to Figlar et al.; 2005/0268925 to Schluter et al.; 2006/0130861 to Luan et al.; and 2006/0174899 to Luan et al., which are incorporated herein by reference.

The filter element 26 may also possess a second filter segment 36 longitudinally disposed relative to the first segment 32 and positioned at the extreme mouth end of the cigarette 10. The second filter segment 36 includes filter material 48 (e.g., cellulose acetate tow impregnated with plasticizer, such as triacetin) that is over-wrapped along the longitudinally extending surface thereof with circumscribing plug wrap material 28. The second filter segment 36 may be substantially free of adsorbent and breakable or rupturable capsules, meaning that such additives are not visible when viewing the extreme mouth end of the filter element 26.

The filter element 26 is circumscribed along its outer circumference or longitudinal periphery by a layer of outer plug wrap 28. The outer plug wrap 28 overlies each of the first filter segment 32 and the second filter segment 36, so as to provide a combined, two-segment filter element.

The filter element 26 is attached to the tobacco rod 12 using tipping material 46 (e.g., essentially air impermeable tipping paper), that circumscribes both the entire length of the filter element 26 and an adjacent region of the tobacco rod 12. The inner surface of the tipping material 46 is fixedly secured to the outer surface of the plug wrap 28 and the outer surface of the wrapping material 16 of the tobacco rod, using a suitable adhesive; and hence, the filter element and the tobacco rod are connected to one another. See also the tipping materials and configurations set forth in U.S. Pat. Publication No. 2008/0029111 to Dube et al., which is incorporated by reference herein.

A ventilated or air diluted smoking article can be provided with an optional air dilution mechanisms, such as a series of perforations 30, each of which extend through the tipping material and plug wrap. The optional perforations 30, shown in FIG. 1, can be made by various techniques known to those of ordinary skill in the art, such as laser perforation techniques. Alternatively, so-called off-line air dilution techniques can be used (e.g., through the use of porous paper plug wrap and pre-perforated tipping paper). For cigarettes that are air diluted or ventilated, the amount or degree of air dilution or ventilation can vary. Frequently, the amount of air dilution for an air diluted cigarette is greater than about 10 percent, generally is greater than about 20 percent, often is greater than about 30 percent, and sometimes is greater than about 40 percent. Typically, the upper level for air dilution for an air diluted cigarette is less than about 80 percent, and often is less than about 70 percent. As used herein, the term "air dilution" is the ratio (expressed as a percentage) of the volume of air drawn through the air dilution means to the total volume and air and smoke drawn through the cigarette and exiting the extreme mouth end portion of the cigarette.

During use, the smoker lights the lighting end 18 of the cigarette 10 using a match or cigarette lighter. As such, the smokable material 12 begins to burn. The mouth end 20 of the cigarette 10 is placed in the lips of the smoker. Thermal decomposition products (e.g., components of tobacco smoke) generated by the burning smokable material 12 are drawn through the cigarette 10, through the filter element 26, and into the mouth of the smoker. During draw, certain amount of certain gaseous components of the mainstream smoke are removed from the mainstream smoke or neutralized by the adsorbent material 50 within the filter element 26. Filters incorporating such adsorbent material 50, such as carbonaceous filter components (e.g., activated charcoal particles), have the capability of capturing a wide range of mainstream tobacco smoke vapor phase components. If desired, prior to, during or after the smoking experience, the smoker can optionally squeeze the filter element. As a result, at least a portion of the optional breakable capsules that remain unbroken can be broken, and hence release the particles 52 of flavoring agent contained therein.

Other filter element arrangements may be produced or formed without departing from embodiments of the present invention. For example, the filter element 26 could include more than the two segments set forth in FIG. 2. Although less preferred, the filter element 26 could also include a cavity formed between two filter material segments, with the adsorbent material 50 and the optional flavoring agent 52 mixed together therein. Although it is preferable to avoid positioning the filter segment comprising the adsorbent material 50 and optional flavor agent 52 at the extreme mouth end of the filter, it is not necessary for the filter segment comprising these additives to be located at the tobacco end of the filter. Instead, the filter segment comprising the dispersed additives can be more centrally located within the filter element 26 with one or more filter segments toward each end that do not contain the additives.

The dimensions of a representative cigarette 10 can vary. Preferred cigarettes are rod shaped, and can have diameters of about 7.5 mm (e.g., circumferences of about 20 mm to about 27 mm, often about 22.5 mm to about 25 mm); and can have total lengths of about 70 mm to about 120 mm, often about 80 mm to about 100 mm. The length of the filter element 30 can vary. Typical filter elements can have total lengths of about 15 mm to about 40 mm, often about 20 mm to about 35 mm. For a typical dual-segment filter element, the downstream or mouth end filter segment often has a length of about 10 mm to about 20 mm; and the upstream or tobacco rod end filter segment often has a length of about 10 mm to about 20 mm.

If desired, suitable catalytic compounds, e.g., for the conversion of carbon monoxide to carbon dioxide, can be incorporated into one or more segments of the filter element 26. Exemplary catalysts include noble metals (e.g., silver, gold, platinum), metal oxides, ceramics, and mixtures thereof.

As illustrated in FIG. 2, one filter element 26 that may be formed in accordance with the present invention comprises multiple, longitudinally-extending segments. Each segment can have varying properties and may include various materials capable of filtration or adsorption of particulate matter and/or vapor phase compounds from the mainstream smoke. Typically, the filter element of various aspects of the invention includes 2 to 6 segments, frequently 2 to 4 segments. In some instances, the filter element 26 may include a mouth end segment and a tobacco end segment, with the tobacco end segment comprising the dispersed adsorbent material 50 and flavoring agent 52.

As shown in FIG. 2, the filter element may incorporate adsorbent material/particulate 50. Such adsorbent material 50 may be a material with relatively high surface area capable of adsorbing smoke constituents without a high degree of specificity, or a material that adsorbs certain compounds with a greater degree of specificity, such as an ion exchange resin. Exemplary types of adsorbent material may include activated carbon, a molecular sieve (e.g., zeolites and carbon molecular sieves), clay, an ion exchange resin, activated alumina, silica gel, meerschaum, and combinations thereof. Any adsorbent material, or mixture of materials, that has the ability to alter the character or nature of mainstream smoke passing through the filter element may be used.

Exemplary ion exchange resins comprise a polymer backbone, such as styrene-divinylbenzene (DVB) copolymers, acrylates, methacrylates, phenol formaldehyde condensates, and epichlorohydrin amine condensates, and a plurality of electrically charged functional groups attached to the polymer backbone, and can be a weak base anion exchange resin or a strong base anion exchange resin. Commercially available embodiments of such resins include DIAION® ion-exchange resins available from Mitsubishi Chemical Corp. (e.g., WA30 and DCA11), DUOLITE® ion exchange resins available from Rohm and Haas (e.g., DUOLITE® A7), and XORBEX resins available from Dalian Trico Chemical Co. of China.

A preferred adsorbent is a carbonaceous material, which is a material that is composed primarily of carbon, and preferred carbonaceous materials are composed of virtually all carbon. Typically carbonaceous materials comprise carbon in amounts of more than about 85 percent, generally more than about 90 percent, often more than about 95 percent, and frequently more than about 98 percent, by weight. The carbonaceous material can have the form of charcoal, but most preferably is an activated carbon material. Activated carbon materials are high surface area materials. Exemplary activated carbon materials have surface areas of more than about 200 $m^2/g$, often more than about 1000 $m^2/g$, and frequently more than about 1500 $m^2/g$, as determined using the Brunaver, Emmet and Teller (BET) method described in J. Amer. Chem. Soc., Vol. 60(2), pp. 309-319 (1938). Suitable examples of such carbonaceous materials are disclosed, for example, in EP 913100 to Jung et al.; WO 2008/043982 to Tennison et al.; WO 2007/104908 to White et al.; WO 2006/103404 to Cashmore et al.; and WO 2005/023026 to Branton et al.; and U.S. Pat. No. 7,370,657 to Zhuang et al.

The filter element 26 may incorporate an effective amount of adsorbent material 50, such as an effective amount of activated carbon. The effective amount is an amount that, when incorporated into the filter element 26, provides some desired degree of alteration of the mainstream smoke of a cigarette incorporating that filter element 26. For example, a cigarette filter element incorporating activated carbon particles or granules can act to lower the yield of certain gas phase components of the mainstream smoke passing through that filter element. Typically, the amount of carbonaceous material or other adsorbent within the filter element is at least about 20 mg, often at least about 30 mg, and frequently at least about 40 mg, on a dry weight basis. Typically, the amount of carbonaceous material or other adsorbent material 50 within the filter element does not exceed about 500 mg, generally does not exceed about 400 mg, often does not exceed about 300 mg, and frequently does not exceed about 200 mg, on a dry weight basis.

The carbonaceous materials can be derived from synthetic or natural sources. Materials such as rayon or nylon can be carbonized, followed by treatment with oxygen to provide activated carbonaceous materials. Materials such as wood and coconut shells can be carbonized, followed by treatment with oxygen to provide activated carbonaceous materials. The level of activity of the carbon may vary. Typically, the carbon has an activity of about 60 to about 150 Carbon Tetrachloride Activity (i.e., weight percent pickup of carbon tetrachloride). Preferred carbonaceous materials are provided by carbonizing or pyrolyzing bituminous coal, tobacco material, softwood pulp, hardwood pulp, coconut shells, almond shells, grape seeds, walnut shells, macadamia shells, kapok fibers, cotton fibers, cotton linters, and the like. Examples of suitable carbonaceous materials are activated coconut hull based carbons available from Calgon Corp. as PCB and GRC-11 or from PICA as G277, coal-based carbons available from Calgon Corp. as S-Sorb, Sorbite, BPL, CRC-11F, FCA and SGL, wood-based carbons available from Westvaco as WV-B, SA-20 and BSA-20, carbonaceous materials available from Calgon Corp. as HMC, ASC/GR-1 and SC II, Witco Carbon No. 637, AMBERSORB 572 or AMBERSORB 563 resins available from Rohm and Haas, and various activated carbon materials available from Prominent Systems, Inc. Other carbonaceous materials are described in U.S. Pat. No. 4,771,795 to White, et al. and U.S. Pat. No. 5,027,837 to Clearman, et al.; and European Patent Application Nos. 236, 922; 419,733 and 419,981.

Preferred carbonaceous materials are coconut shell types of activated carbons available from sources such as Calgon Carbon Corporation, Gowrishankar Chemicals, Carbon Activated Corp. and General Carbon Corp. See, also, for example, Activated Carbon Compendium, Marsh (Ed.) (2001), which is incorporated herein by reference.

Certain carbonaceous materials can be impregnated with substances, such as transition metals (e.g., silver, gold, copper, platinum, and palladium), nanoparticles, potassium bicarbonate, tobacco extracts, polyethyleneimine, manganese dioxide, eugenol, and 4-ketononanoic acid. The carbon composition may also include one or more fillers, such as semolina. Grape seed extracts may also be incorporated into the filter element 20 as a free radical scavenger. Sintered or foamed carbon materials (see, e.g., U.S. Pat. No. 7,049,382 to Haftka et al.) or gathered webs (see, e.g., US Pat. Appl. Pub. No. US 2008/0092912 to Robinson et al. and US 2007/0056600 to Coleman, III et al.) may be other options for incorporating an adsorbent material 50 into a filter element 20.

Various types of charcoals and activated carbon materials suitable for incorporation into cigarette filters, various other filter element component materials, various types of cigarette filter element configurations and formats, and various manners and methods for incorporating carbonaceous materials into cigarette filter elements, are set forth in U.S. Pat. No. 3,217,715 to Berger et al.; U.S. Pat. No. 3,648,711 to Berger et al.; U.S. Pat. No. 3,957,563 to Sexstone; U.S. Pat. No. 4,174,720 to Hall; U.S. Pat. No. 4,201,234 to Neukomm; U.S. Pat. No. 4,223,597 to Lebert; U.S.Pat. No. 5,137,034 to Perfetti et al.; U.S. Pat. No. 5,360,023 to Blakley et al.; U.S. Pat. No. 5,568,819 to Gentry et al.; U.S. Pat. No.5,622,190 to Arterbery et al.; U.S. Pat. No. 6,537,186 to Veluz; U.S. Pat. No. 6,584,979 to Xue et al.; U.S. Pat. No. 6,761,174 to Jupeet al.; U.S. Pat. No. 6,789,547 to Paine III; and U.S. Pat. No. 6,789,548 to Bereman; US Pat. Appl. Pub. Nos. 2002/0166563 to Jupe et al.; 2002/0020420 to Xue et al.; 2003/0200973 to Xue et al.; 2003/0154993 to Paine et al.; 2003/0168070 to Xue et al.; 2004/0194792 to Zhuang et al.; 2004/0226569 to Yang et al.; 2004/0237984 to Figlar et al.; 2005/0133051 to Luan et al.; 2005/0049128 to Buhl et al.; 2005/0066984 to Crooks et al.; 2006/0144410 to Luan et al.; 2006/0180164 to Paine, III et al.; and 2007/0056600 to Coleman, III et al.; European Pat. Appl. 579410 to White; and PCT WO 2006/064371 to Banerjea et al.; which are incorporated herein by reference. Representative types of cigarettes possessing filter elements incorporating carbonaceous materials have been available as "Benson & Hedges Multifilter" by Philip Morris Inc., in the State of Florida during 2005 as a Philip Morris Inc. test market brand known as "Marlboro Ultra Smooth," and as "Mild Seven" by Japan Tobacco Inc.

In light of the aforementioned issues associated with insertion of loose particulates or granules of carbonaceous material into the filter element as either a loose powder or a slurry, which may be inconsistent, wasteful, inefficient, and/or "messy," one aspect of the present disclosure, as shown, for example, in FIGS. 3A-3D, involves engaging the adsorbent material 50 with a carrier material 55 prior to insertion of the resulting assembly into the filter element 26 (or a continuous filter rod before longitudinal severance thereof to form multiple filter elements 26). Selection of a suitable carrier material 55 may facilitate, for example, improved production by more effectively and efficiently inserting the now "captive" adsorbent material 50 into the filter element 26. That is, the adsorbent material 50 is carried by the carrier material 55 upon insertion thereof into the filter element 26. In some embodiments, the carrier material 55 may be in the form of, for example, a pellet (FIG. 3A), a capsule (FIG. 3B), a tube (FIG. 3C), a continuous elongate structure, a continuous strip, a strand or the like capable of receiving and "holding captive" the adsorbent material 50 (FIG. 3D) so as to facilitate insertion thereof into the filter element 26 in a cleaner, more effective manner In some embodiments, individual or multiple forms of the carrier material 55 may be inserted into the filter element 26. For example, individual or multiple capsules, tubes, pellets, etc. or combinations thereof may be inserted into the filter element 26 in accordance with various aspects.

In some instances, the carrier material 55 may comprise a matrix material, such as, for example, a polymer material, which may be impregnated with the adsorbent material 50 (i.e., the adsorbent material 50 may be suspended in or otherwise held by the matrix material) such that the adsorbent material 50 may be carried with and by the matrix material into the filter element 26. For example, in some embodiments, the matrix material may comprise a high-density or low-density polymer material, such as, for example, polyethylene or polypropylene, impregnated with the adsorbent material 50 or otherwise having the adsorbent material 50, such as, for example, a carbonaceous material (e.g., activated carbon, charcoal) dispersed therein. Preferably, the adsorbent material 50 is relatively evenly dispersed, but such even dispersion may not be absolutely necessary. In embodiments where the carrier material 55 is formed as a tubular or capsular member, the adsorbent material 50 may be inserted into the tubular or capsular member so as to be contained thereby upon insertion into the filter element 26. In embodiments where the carrier material 55 is formed as a continuous elongate structure, the adsorbent material 50 may engage, contact, or otherwise interact with the continuous elongate structure such that the adsorbent material 50 can be carried into the filter element 26 thereby. In embodiments where the carrier material 55 is formed as a continuous strip, the continuous strip may be lengthwise wrapped around the adsorbent material 50 so as to contain the adsorbent material 50 therein (i.e., similar to a "tube") for insertion into the filter element 26.

Accordingly, the carrier material 55 may have a form that can be generally characterized as a containment or capturing vehicle for the adsorbent material 50 that hold the same in a relatively secure manner such that the adsorbent material 50 can be delivered into the filter element/rod 26 via the carrier material 55 in a captive manner, as compared to the loose powdered, granular, or particulate form of the adsorbent material 50 inserted within filter element 26 of smoking articles in some prior art processes. As such, the insertion or incorporation of the carrier material 55 carrying the adsorbent material 50 into the filter element 26 may be accomplished in a "cleaner" and more consistent and efficient manner (i.e., since the adsorbent material 50 is held "captive"), as compared to directing a loose powdered adsorbent material 50, or slurry form thereof, into the filter elements 26 (i.e., less dust, spillage, overflow, contamination, cross-contamination, etc.). Such benefits may, in turn, translate into, for instance, less maintenance, a faster process, higher efficiency and/or more consistent delivery of the adsorbent material 50, and increased safety. Further, the carrier material 55 may be readily configured in any manner suitable for facilitating insertion thereof into individual filter elements 26. Other advantages may include a consistent measured size and/or amount of an adsorbent material introduced into, partially disposed in, deposited in, intimately placed with, centrally located in, disposed within, extending substantially all the way through, or otherwise engaged with the filter material of the filter element of the smoking article. In some instances, a matrix material such as a gel-type substance or otherwise suitable substance may contain, though not necessarily through impregnation, the adsorbent material 50 in a form capable of being incorporated within an individual filter element 26. In other instances, the carrier material 55 carrying the adsorbent material 50 may comprise a strand, strip, or otherwise elongate structure that is severed to form individual portions capable of being inserted into the filter rod and/or filter element 26.

In some instances, the carrier material 55 may be in the form of a pellet. In such instances, the pellets may be produced using devices such as the FL-M Series granulator equipment (e.g., FL-M-3) from Vector Corporation and as WP 120V and WP 200VN from Alexanderwerk, Inc. Exemplary compaction devices, such as compaction presses, are available as Colton 2216 and Colton 2247 from Vector Corporation and as 1200i, 2200i, 3200, 2090, 3090 and 4090 from Fette Compacting. Devices for providing outer coating layers to compacted pelletized formulations are available as CompuLab 24, CompuLab 36, Accela-Cota 48 and Accela-Cota 60 from Thomas Engineering.

The pellets may be manufactured using a wide variety of extrusion techniques. For example, such pellets may be manufactured using co-extrusion techniques (e.g., using a twin screw extruder). In such a situation, successive wet or dry components or component mixtures can be placed within separate extrusion hoppers. Steam, gases (e.g., ammonia, air, carbon dioxide, and the like), and humectants (e.g., glycerin or propylene glycol) can be injected into the extruder barrel as each dry mix is propelled, plasticized, and cooked. As such, the various components are processed so as to be very well mixed, and hence, come in complete contact with each other. For example, the contact of components is such that individual components (e.g., adsorbent material or flavoring agents) may be well embedded in the extrusion matrix or extrudate. See, for example, U.S. Pat. No. 4,821,749 to Toft et al., which is incorporated herein by reference.

The carrier material 55 carrying the adsorbent material 50 may be incorporated within a segment of a cavity filter (e.g., as pellets within the central cavity region of a three-segment or stage filter element). Alternatively, the carrier material 55 carrying the adsorbent material 50 may be dispersed within a fibrous filter material (e.g., as pellets dispersed throughout a filter tow or gathered non-woven web material) as a segment of a longitudinally multi-segmented filter element (e.g., a two-segment filter element).

According to another aspect of the present invention, after insertion of the carrier material 55/adsorbent material 50 assembly into the filter element 26 (or the continuous filter rod), the adsorbent material 50 may be released from the carrier material 55 and into the filter material. For example, carrier material 55 may be dissolved, disintegrated, degraded, or otherwise destroyed in situ so as to release and/or disperse or otherwise effectively expose the adsorbent material 50 into the filter element 26 such that the adsorbent material 50 can have the desired effect on the mainstream smoke drawn through the filter element 26. Accordingly, a representative cigarette filter element 26 may possess the adsorbent material 50 within at least one component or segment of the filter element in a manner sufficient to affect the mainstream smoke gas phase removal within the filter element 26.

In instances, where the adsorbent material 50 comprises a carbonaceous material, the moisture content of the carbonaceous material (or any other suitable adsorbent) can vary. Typically, the moisture content of the carbonaceous material or other adsorbent within the filter element, prior to use of the cigarette incorporating that filter element, is less than about 30 percent, often less than about 25 percent, and frequently less than about 20 percent, based on the combined weight of the carbonaceous material and moisture. Typically, the moisture content of the carbonaceous material or other adsorbent within the filter element, prior to use of the cigarette incorporating that filter element, is greater than about 3 percent, often greater than about 5 percent, and frequently greater than about 8 percent, based on the combined weight of the carbonaceous material and moisture.

In some instances, an optional flavoring agent may also be impregnated or otherwise suspended or included within or on the carrier material 55, in addition to the adsorbent material 50. That is, the carrier material 55 may carry both the adsorbent material 50 and a flavoring agent into the filter element 26. As such, the complexity of the formation process for the filter element 26 and/or smoking article may be reduced. For example, in some embodiments, the carrier material 55 may comprise a polymer matrix material impregnated with the adsorbent material 50, such as, for example, a carbonaceous material, and an optional flavoring agent. Accordingly, a single insertion device/step may only be needed to insert the adsorbent material 50 and the optional flavoring agent, rather than using multiple insertion devices/steps to insert the adsorbent material 50 and the optional flavoring agent (i.e., in the form of a rupturable capsule) into the filter element 26.

In other embodiments of the present invention, the adsorbent material 50 may be formed as a sphere, pellet, capsule, tube or other structured object, with or without the carrier material 55. For example, the pellets may be manufactured using a wide variety of extrusion techniques. For instance, such pellets may be manufactured using co-extrusion techniques (e.g., using a twin screw extruder). For example, a spherical carbon object may be formed so as to be more easily inserted into the filter material (e.g., cellulose acetate tow). In some instances, the as-formed adsorbent material 50 may be provided with a carrier material 55 in the form of an "outer shell" through the application of, for example, food grade shellac, ethyl cellulose, any suitable hydrophobic coating, or an electrostatically-applied material, to the adsorbent material object. Such a resulting object may be inserted with an object-insertion device, as commonly known in the art, such as those used to insert rupturable capsules containing flavoring agents. As such, one skilled in the art will appreciate that spheres, capsules, or other forms of the adsorbent material 50 may be inserted in a similar manner (as well as embodiments wherein the carrier material 55 carries the adsorbent material 50). In such embodiments, for example, one or more spherical carbon objects may be disposed within the filter material of the smoking article. Such objects formed as a sphere, pellet, tube, etc. may provide a concentrated form of the adsorbent material 50 into the filter material. As such, the particles comprising the object may have to be released and/or dispersed into or otherwise exposed to the filter element 26 to have the desired effect. For example, a force (physical, sound wave, or otherwise) may be employed while the object is disposed in situ within the filter element 26 to rupture, crack, or otherwise break, degrade, or disintegrate the adsorbent material 50 and/or carrier material 55 comprising the object so as to disperse or otherwise release the adsorbent material 50 into the filter element 26. This step may occur at any point after which the object has been inserted into the filter material. That is, this step could be employed late in the manufacturing process, such as after fabrication of the entire smoking article. In other instances, the step may occur directly after insertion of the object into the filter rod.

The size and weight of a capsule may vary. Certain types of capsules are generally spherical in shape. However, suitable capsules may have other types of shapes, such as generally rectilinear, oblong, elliptical, or oval shapes. Exemplary generally spherical capsules have diameters of less than about 3.5 mm, generally less than about 1.5 mm, often less than about 1 mm, and frequently less than about 0.5 mm. For example, several capsules can be employed, and those capsules can be in the range of about 0.25 mm to about 2 mm in diameter. A plurality of very small capsules, commonly referred to as "microcapsules," can also be incorporated within the filter element (see, e.g., various microencapsulation options available from Euracli, which protect the active ingredient (from oxidation, humidity, etc.) and allows the active ingredient to be released at the desired moment either by rupture of the membrane when subjected to a precise mechanical action or via a protracted diffusion through the membrane for an extended effect), wherein such microcapsules may, in some instances, be held together in a cohesive manner by an appropriate binder material. The total weight of the capsules contained within the filter may vary, but is typically greater than about 10 mg, often greater than about 20 mg, and can be greater than about 30 mg. The total weight of the capsules is typically less than about 200 mg, often less than about 100 mg, and can be less than 50 mg.

The number of capsules incorporated into the filter element can vary, depending upon factors such as the size of the capsules, the character or nature of the payload (i.e., adsorbent material, optional flavoring agent or both), the positioning of the capsules within the filter element, and the like. The number of capsules incorporated within the relevant region of the filter element can exceed about 5, can exceed about 10, can exceed about 20, can exceed about 40, and can even exceed about 100. In certain embodiments, the number of capsules can be greater than about 500, and even greater than about 1,000. Larger numbers of capsules in certain embodiments can be advantageous because it can provide the smoker with increased control over the smoke-affecting properties of the payload.

Filter elements of the present invention can be incorporated within the types of cigarettes set forth in U.S. Pat. No. 4,756,318 to Clearman et al.; U.S. Pat. No. 4,714,082 to Banerjea et al.; U.S. Pat. No. 4,771,795 to White et al.; U.S. Pat. No. 4,793,365 to Sensabaugh et al.; U.S. Pat. No. 4,989,619 to Clearman et al.; U.S. Pat. No. 4,917,128 to Clearman et al.;

U.S. Pat. No. 4,961,438 to Korte; U.S. Pat. No. 4,966,171 to Serrano et al.; U.S. Pat. No. 4,969,476 to Bale et al.; U.S. Pat. No. 4,991,606 to Serrano et al.; U.S. Pat. No. 5,020,548 to Farrier et al.; U.S. Pat. No. 5,027,836 to Shannon et al.; U.S. Pat. No. 5,033,483 to Clearman et al.; U.S. Pat. No. 5,040,551 to Schlatter et al.; U.S. Pat. No. 5,050,621 to Creighton et al.; U.S. Pat. No. 5,052,413 to Baker et al.; U.S. Pat. No. 5,065,776 to Lawson; U.S. Pat. No. 5,076,296 to Nystrom et al.; U.S. Pat. No. 5,076,297 to Farrier et al.; U.S. Pat. No. 5,099,861 to Clearman et al.; U.S. Pat. No. 5,105,835 to Drewett et al.; U.S. Pat. No. 5,105,837 to Barnes et al.; U.S. Pat. No. 5,115,820 to Hauser et al.; U.S. Pat. No. 5,148,821 to Best et al.; U.S. Pat. No. 5,159,940 to Hayward et al.; U.S. Pat. No. 5,178,167 to Riggs et al.; U.S. Pat. No. 5,183,062 to Clearman et al.; U.S. Pat. No. 5,211,684 to Shannon et al.; U.S. Pat. No. 5,240,014 to Deevi et al.; U.S. Pat. No. 5,240,016 to Nichols et al.; U.S. Pat. No. 5,345,955 to Clearman et al.; U.S. Pat. No. 5,396,911 to Casey, III et al.; U.S. Pat. No. 5,551,451 to Riggs et al.; U.S. Pat. No. 5,595,577 to Bensalem et al.; U.S. Pat. No. 5,727,571 to Meiring et al.; U.S. Pat. No. 5,819,751 to Barnes et al.; U.S. Pat. No. 6,089,857 to Matsuura et al.; U.S. Pat. No. 6,095,152 to Beven et al; and U.S. Pat. No. 6,578,584 Beven; and US Pat. Appl. Serial Nos. US 2007/0215167 to Crooks et al. and US 2008/00092912 to Robinson et al.; which are incorporated herein by reference. For example, filter elements of the present invention can be incorporated within the types of cigarettes that have been commercially marketed under the brand names "Premier" and "Eclipse" by R. J. Reynolds Tobacco Company. See, for example, those types of cigarettes described in Chemical and Biological Studies on New Cigarette Prototypes that Heat Instead of Burn Tobacco, R. J. Reynolds Tobacco Company Monograph (1988) and Inhalation Toxicology, 12:5, p. 1-58 (2000); which are incorporated herein by reference.

Cigarette rods typically are manufactured using a cigarette making machine, such as a conventional automated cigarette rod making machine. Exemplary cigarette rod making machines are of the type commercially available from Molins PLC or Hauni-Werke Korber & Co. KG. For example, cigarette rod making machines of the type known as MkX (commercially available from Molins PLC) or PROTOS (commercially available from Hauni-Werke Korber & Co. KG) can be employed. A description of a PROTOS cigarette making machine is provided in U.S. Pat. No. 4,474,190 to Brand, at col. 5, line 48 through col. 8, line 3, which is incorporated herein by reference. Types of equipment suitable for the manufacture of cigarettes also are set forth in U.S. Pat. No. 4,781,203 to La Hue; U.S. Pat. No. 4,844,100 to Holznagel; U.S. Pat. No. 5,131,416 to Gentry; U.S. Pat. No. 5,156,169 to Holmes et al.; U.S. Pat. No. 5,191,906 to Myracle, Jr. et al.; U.S. Pat. No. 6,647,870 to Blau et al.; U.S. Pat. No. 6,848,449 to Kitao et al.; and U.S. Pat. No. 6,904,917 to Kitao et al.; and U.S. Patent Application Publication Nos. 2003/0145866 to Hartman; 2004/0129281 to Hancock et al.; 2005/0039764 to Barnes et al.; and 2005/0076929 to Fitzgerald et al.; each of which is incorporated herein by reference.

The components and operation of conventional automated cigarette making machines will be readily apparent to those skilled in the art of cigarette making machinery design and operation. For example, descriptions of the components and operation of several types of chimneys, tobacco filler supply equipment, suction conveyor systems and garniture systems are set forth in U.S. Pat. No. 3,288,147 to Molins et al.; U.S. Pat. No. 3,915,176 to Heitmann et al.; U.S. Pat. No. 4,291,713 to Frank; U.S. Pat. No. 4,574,816 to Rudszinat; U.S. Pat. No. 4,736,754 to Heitmann et al. U.S. Pat. No. 4,878,506 to Pinck et al.; U.S. Pat. No. 5,060,665 to Heitmann; U.S. Pat. No. 5,012,823 to Keritsis et al. and U.S. Pat. No. 6,360,751 to Fagg et al.; and U.S. Patent Publication No. 2003/0136419 to Muller; each of which is incorporated herein by reference. The automated cigarette making machines of the type set forth herein provide a formed continuous cigarette rod or smokable rod that can be subdivided into formed smokable rods of desired lengths.

Various types of cigarette components, including tobacco types, tobacco blends, top dressing and casing materials, blend packing densities and types of paper wrapping materials for tobacco rods, can be employed. See, for example, the various representative types of cigarette components, as well as the various cigarette designs, formats, configurations and characteristics, that are set forth in Johnson, Development of Cigarette Components to Meet Industry Needs, 52$^{nd}$ T.S.R.C. (September, 1998); U.S. Pat. No. 5,101,839 to Jakob et al.; U.S. Pat. No. 5,159,944 to Arzonico et al.; U.S. Pat. No. 5,220,930 to Gentry and U.S. Pat. No. 6,779,530 to Kraker; U.S. Patent Publication Nos. 2005/0016556 to Ashcraft et al.; 2005/0066986 to Nestor et al.; 2005/0076929 to Fitzgerald et al.; and 2007/0056600 to Coleman, III et al; U.S. patent application Serial No. 11/375,700, filed Mar. 14, 2006, to Thomas et al. and Ser. No. 11/408,625, filed Apr. 21, 2006, to Oglesby; each of which is incorporated herein by reference. Most preferably, the entire smokable rod is composed of smokable material (e.g., tobacco cut filler) and a layer of circumscribing outer wrapping material.

As such, another aspect of the present invention comprises an apparatus suitably configured for incorporating the adsorbent material 50 with the carrier material 55, and, in some instances, an optional flavoring agent 52, forming the filter element of the smoking article by incorporating the carrier material 55 carrying the adsorbent material 50, and/or for forming the smoking article itself having such a filter element incorporating the carrier material 55/adsorbent material 50. To that end, apparatuses have been developed for providing filter rods for use in the manufacture of smoking articles, wherein each rod has one or more forms of the carrier material 55 (e.g., pellets, capsules, strands, or combinations thereof) carrying the adsorbent material 50, disposed along the length of the rod, such that, when the rod is subdivided into rod portions, each rod portion includes at least one form of the carrier material 55 carrying the adsorbent material 50. See, for example, U.S. Pat. No. 7,115,085 to Deal, which is incorporated herein by reference in its entirety. Such apparatuses can incorporate equipment for supplying a continuous supply of filter material (e.g., a filter tow processing unit adapted to supply filter tow to a continuous rod forming unit). A representative apparatus may also include, for example, an object delivery device such as a hopper and rotating wheel arrangement disclosed in U.S. Patent Application Publication No. US 2007/0068540 A1 to Thomas et al. (and incorporated herein by reference), for supplying certain forms of the carrier material 55 carrying the adsorbent material 50 into the filter material. In still other instances, multiple forms of the carrier material 55 (i.e., pellets and/or strands, or at least one of a pellet or strand in combination with at least one other of the pellet or strand) can be inserted into the filter material by an object-insertion unit. Arrangements for inserting such strands/objects into the filter material are disclosed, for example, in U.S. patent application Ser. No. 11/461,941 to Nelson et al. (US 2008/0029118 A1) and U.S. patent application Ser. No. 11/760,983 to Stokes et al., which are incorporated herein by reference.

Figure 4:
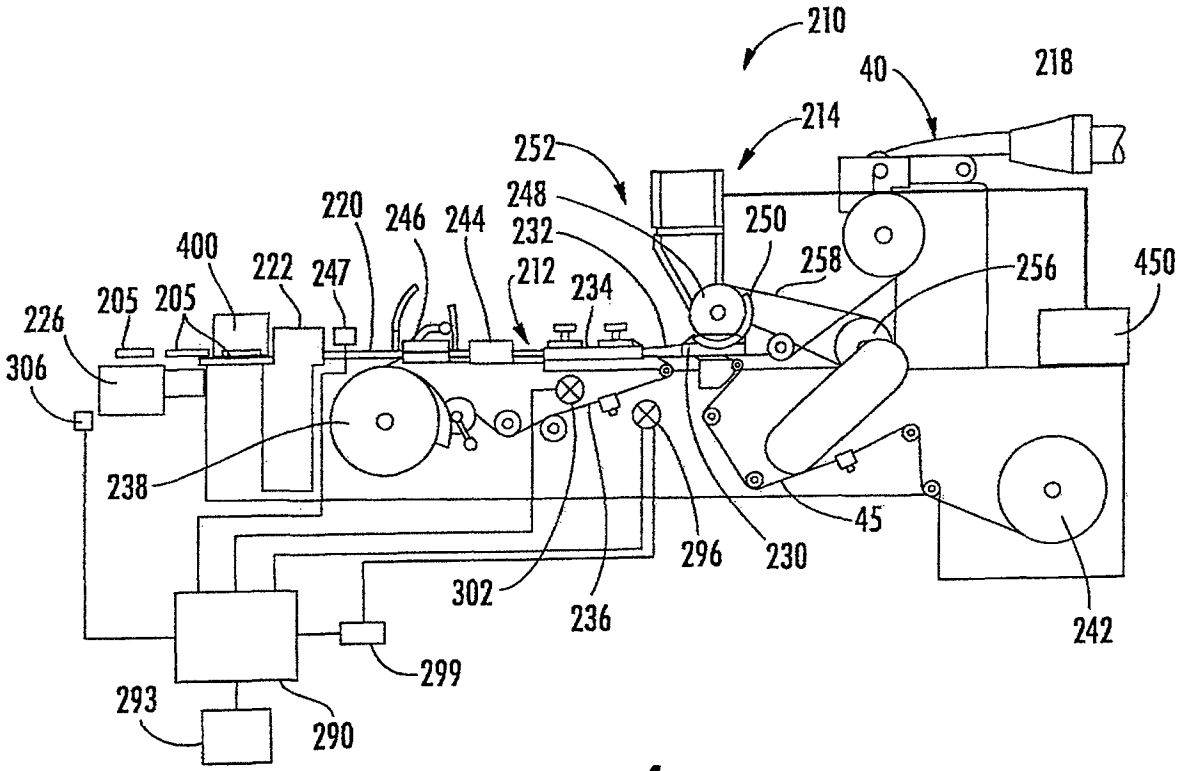
FIG. 4 is a schematic of a rod-making apparatus including a portion of the filter tow processing unit, a source of an adsorbent material carried by a carrier material, an insertion unit, and a filter rod-forming unit, in accordance with one embodiment of the present invention.

A rod-making apparatus 210 as illustrated in FIG. 4, in some instances, may include a forming unit 450 configured to engage the adsorbent material 50 with the carrier material 55 in an on-line or off-line manner to form an insertion object. For example, the forming unit 450 may be configured to insert the adsorbent material 50 into a tubular or capsular member comprising the carrier material 55, to suspend the adsorbent material 50 in a matrix material comprising the carrier material 55, to engage the adsorbent material 50 with a continuous elongate member comprising the carrier material 55, and/or to wrap a continuous strip member comprising the carrier material 55 about the adsorbent material 50. Once the insertion object is formed, the insertion object can be delivered from the forming unit 450 to an insertion unit/device 214 configured to insert the carrier material 55 carrying the adsorbent material 50 into the filter material. In some instances, the forming unit may be in cooperation with or otherwise linked to such an insertion unit/device 214 (i.e., on-line vs off-line). Still in other embodiments, the forming unit 450 and the insertion unit/device 214 may be a single unit configured to perform both functions of forming the carrier material 55 carrying the adsorbent material 50, and inserting the carrier material 55 carrying the adsorbent material 50 into the filter material.

During the manufacturing process, the filter material may be formed into a continuous rod having the carrier material 55 carrying the adsorbent material 50 disposed therein and extending along the longitudinal axis thereof. The continuous rod then may be subdivided at predetermined intervals so as to form a plurality of filter rods or rod portions such that each rod portion includes at least a portion of the adsorbent material 50 therein. In instances of the carrier material 55 comprising, for example, a pellet and a strand, the pellets may be disposed at predetermined positions within and along the filter rod or filter element, while the strand, if any, extends through the filter rod or filter element.

As shown in FIG. 4, an exemplary rod-making apparatus 210 may include a rod-forming unit 212 (e.g., a KDF-2 unit available from Hauni-Werke Korber & Co. KG) and an object-insertion unit 214 suitably adapted to provide for placement of the insertion object(s) along a continuous length of filter material 40. The continuous length or web of filter material may be supplied from a source (not shown) such as a storage bale, bobbin, spool or the like. Generally, the filter material 40 may be processed using a filter material processing unit 218. The continuous length of filter material has the carrier material 55 carrying the adsorbent material 50 incorporated therein by the object insertion unit 214, and is then passed through the rod-forming unit 212 to thereby forming a continuous rod 220. The continuous rod 220 can be subdivided using a rod cutting assembly 222 into a plurality of rod portions 205 each having at least a portion of the adsorbent material 50 disposed therein. The succession or plurality of rod portions 205 may be collected for use in collection device 226 which may be a tray, a rotary collection drum, conveying system, or the like. If desired, the rod portions can be transported directly to a cigarette making machine.

The filter material 40 can vary, and can be any material of the type that can be employed for providing a tobacco smoke filter for cigarettes. Preferably a traditional cigarette filter material is used, such as cellulose acetate tow, gathered cellulose acetate web, polypropylene tow, gathered cellulose acetate web, gathered paper, strands of reconstituted tobacco, or the like. Especially preferred is filamentary tow such as cellulose acetate, polyolefins such as polypropylene, or the like. One highly preferred filter material that can provide a suitable filter rod is cellulose acetate tow having 3 denier per filament and 40,000 total denier. As another example, cellulose acetate tow having 3 denier per filament and 35,000 total denier can provide a suitable filter rod. As another example, cellulose acetate tow having 8 denier per filament and 40,000 total denier can provide a suitable filter rod. For further examples, see the types of filter materials set forth in U.S. Pat. No. 3,424,172 to Neurath; U.S. Pat. No. 4,811,745 to Cohen et al.; U.S. Pat. No. 4,925,602 to Hill et al.; U.S. Pat. No. 5,225,277 to Takegawa et al. and U.S. Pat. No. 5,271,419 to Arzonico et al.

Filamentary tow, such as cellulose acetate, may be processed using a conventional filter tow processing unit 218 such as a commercially available E-60 supplied by Arjay Equipment Corp., Winston-Salem, N.C. Other types of commercially available tow processing equipment, as are known to those of ordinary skill in the art, may similarly be used. Normally a plasticizer such as triacetin or carbowax is applied to the filamentary tow in traditional amounts using known techniques. In one embodiment, the plasticizer component of the filter material comprises triacetin and carbowax in a 1:1 ratio by weight. The total amount of plasticizer is generally about 4 to about 20 percent by weight, preferably about 6 to about 12 percent by weight. Other suitable materials or additives used in connection with the construction of the filter element will be readily apparent to those skilled in the art of cigarette filter design and manufacture. See, for example, U.S. Pat. No. 5,387,285 to Rivers, which is incorporated herein by reference.

The continuous length of filter material 40 may be pulled through a block 230 by the action of the rod-forming unit 212, and the carrier material 55 carrying the adsorbent material 50 may be inserted along the length of and within the web of filter material. However, the carrier material 55 carrying the adsorbent material 50 may also be introduced into the filter material at other points in the process, and this exemplary embodiment is not intended to be limiting in that regard. The filter material may be further directed into a gathering region 232 of the rod-forming unit 212. The gathering region can have a tongue and horn configuration, a gathering funnel configuration, stuffer or transport jet configuration, or other suitable type of gathering device. The tongue 232 provides for further gathering, compaction, conversion or formation of the cylindrical composite from block 230 into an essentially cylindrical (i.e., rod-like) shape whereby the continuously extending strands or filaments of the filter material extend essentially along the longitudinal axis of the cylinder so formed. In some instances, the carrier material 55 carrying the adsorbent material 50 may also be placed into the filter material in the gathering region 232, as appropriate.

The filter material 40, which has been compressed into a cylindrical composite, is received further into the rod-forming unit 212. The cylindrical composite is fed into wrapping mechanism 234, which includes endless garniture conveyer belt 236 or other garniture device. The garniture conveyer belt 236 is continuously and longitudinally advanced using advancing mechanism 238 such as a ribbon wheel or cooperating drum so as to transport the cylindrical composite through wrapping mechanism 234. The wrapping mechanism provides a strip of wrapping material 28 (e.g., non-porous paper plug wrap) to the outer surface of the cylindrical composite in order to produce the continuous wrapped rod 220. In some instances, the carrier material 55 carrying the adsorbent material 50 may also be engaged with the filter material in the wrapping or garniture region 232, as appropriate. For example, the elongate member, as otherwise disclosed herein, may be in the form of a wrapping material 28 having the carrier material 55 carrying the adsorbent material 50 attached thereto or otherwise engaged therewith.

Generally, the strip or web of wrapping material 28 may provided from rotatable bobbin 242. The wrapping material may be drawn from the bobbin, trained over a series of guide rollers, passed under block 230, and enter the wrapping mechanism 234 of the rod-forming unit. The endless garniture conveyer belt 236 transports both the strip of wrapping material and the cylindrical composite in a longitudinally extending manner through the wrapping mechanism 234 while draping or enveloping the wrapping material about the cylindrical composite.

The seam formed by an overlapping marginal portion of wrapping material has adhesive (e.g., hot melt adhesive) applied thereto at applicator region 244 in order that the wrapping material can form a tubular container for the filter material. Alternatively, the hot melt adhesive may be applied directly upstream of the wrapping material's entry into the garniture of the wrapping mechanism 234 or block 230, as the case may be. The adhesive can be cooled using chill bar 246 in order to cause rapid setting of the adhesive. It is understood that various other sealing devices and other types of adhesives can be employed in providing the continuous wrapped rod.

The continuous wrapped rod 220 passes from the sealing device and is subdivided (e.g., severed) at regular intervals at the desired, predetermined length using cutting assembly 222 which includes as a rotary cutter, a highly sharpened knife, or other suitable rod cutting or subdividing device. It is particularly desirable that the cutting assembly does not flatten or otherwise adversely affect the shape of the rod. The rate at which the cutting assembly severs the continuous rod at the desired points is controlled via an adjustable mechanical gear train (not shown), or other suitable device. The rate at which the carrier material 55 carrying the adsorbent material 50 is inserted into the continuous web of filter material may be in a direct relationship to the speed of operation of the rod-making machine. The insertion unit can be geared in a direct drive relationship to the drive assembly of the rod-making apparatus. Alternatively, the insertion unit 214 can have a direct drive motor synchronized with the drive assembly of the rod-forming unit. In some instances, the insertion unit 214 may be configured to be in communication with an inspection/detection system 247, for example, in the form of a feedback loop, whereby some defects detected by the inspection/detection system 247 may be eliminated by adjusting the upstream insertion unit 214. In light of the relationship of the rate of object insertion and the rod-making machine, embodiments of the present invention are also directed to maintaining or increasing the production rate of the rod-making machine, without adversely affecting the placement of the carrier material 55 carrying the adsorbent material 50 within the filter material.

The insertion unit 214 may include a rotatable insertion member 248 having the shape of a wheel, which may be positioned so as to rotate in a vertical plane. The insertion unit 214 may also include a hopper assembly 252 and/or other transfer device for feeding or otherwise providing transfer of various forms of the carrier material 55 (such as, for example, pellets) to insertion member 248. As the insertion member 248 rotates, the carrier material 55 on the peripheral face of the wheel is brought into contact with the filter material 40 within the block 230, where the carrier material 55 is ejected from the pockets into the gathered filter material 40. Details of such an object-insertion arrangement are further detailed, for example, in U.S. Pat. No. 7,115,085 to Deal; U.S. Pat. No. 4,862,905 to Green, Jr. et al. (i.e., insertion of individual strand portions); U.S. Patent Application Publication No. US 2007/0068540 A1 to Thomas et al. (i.e., insertion of capsules); U.S. patent application Ser. No. 11/461,941 to Nelson et al. (i.e., insertion of continuous strands); and U.S. patent application Ser. No. 11/760,983 to Stokes et al. (i.e., insertion of continuous strands).

Such object-insertion apparatuses may include, for example, a tongue or tongue portion configured to gather the supply of filter material into a continuous rod and/or an insertion unit for inserting a tubular member having the adsorbent material 50 therein into the filter material. In some instances, various forms of the carrier material 55 may be serially attached or otherwise serially engaged with each other so as to form a continuous chain, wherein the insertion unit 214 may be configured to place the continuous chain into the filter material. Certain forms of the carrier material 55 may also be attached or otherwise engaged with an elongate member, wherein the elongate member may comprise, for example, a strand, and the carrier material 55 is thus strung together by the strand. Multiple forms of the carrier material 55 (i.e., pellets and/or strands) or at least one of a pellet or strand in combination with at least one other of the pellet or strand may be inserted into the filter material by the insertion unit 214. One arrangement for inserting a strand into the filter material is disclosed, for example, in U.S. patent application Ser. No. 11/461,941 to Nelson et al., which is incorporated herein by reference. In another example, the elongate member may also be configured to extend laterally (i.e., as a two dimensional sheet). As such, the rod-forming apparatus 210 may include a garniture device configured to wrap the elongate member having the adsorbent material 50 attached thereto about the filter material such that the elongate member forms a wrap encompassing the filter material and the adsorbent material 50 such as disclosed in U.S. patent application Ser. No. 11/760,983 to Stokes et al., which is incorporated herein by reference.

After insertion of the carrier material 55 carrying the adsorbent material 50 into the continuous rod of filter material, the adsorbent material may be optionally released from the carrier material and into the filter material. For example, the carrier material 55 may be dissolved, disintegrated, degraded, or otherwise destroyed so as to release and/or disperse the adsorbent material 50 into the filter material so as to allow the adsorbent material 50 to have the desired effect on the mainstream smoke drawn through the filter element. The release of the adsorbent material into the filter material may occur before or after the continuous rod has been severed into filter segments (e.g., filter element 26). Such release can occur during the manufacturing process or, in some instances, may be effectuated by the smoker prior to smoking the smoking article. In some embodiments, an adsorbent material releasing unit 400 may be provided downstream in the production line from the insertion unit 214, wherein the adsorbent material releasing unit 400 may be configured to interact with the carrier material 55 in situ within the filter element so as to release the adsorbent material 50 into the filter material using, for example, a thermal process, an ultrasonic process, or any other suitable mechanism for releasing the adsorbent material 50 from the carrier material 55.

More particularly, the adsorbent material 50 may be, for example, plasticized (i.e., moistened to form a "paste") such that the resulting object is resilient, flexible, and/or otherwise capable of being handled (see, e.g., U.S. Pat. No. 4,862,905 to Green, Jr. et al.). Once the object is inserted into the filter material, the adsorbent material 50 can then be processed into a releasable form, for instance, by a heating and/or drying procedure applied to the filter element having the object therein. That is, the heating/drying process may cause the plasticizer to be removed from the object, which then becomes brittle or otherwise breakable. The filter element can then be mechanically processed, for example, through opposed rollers, through an "impact" process (i.e., sonic vibration, heating/cooling cycles, etc.), and/or through an irradiation procedure (i.e., microwave energy causing the expansion of liquid/gas associated with the object, leading to the breakdown of the object structure).

In some instances, various forms of the adsorbent material 50 (i.e., strands, beads, pellets, capsules, or combinations thereof) may be disposed in a closed cell foam as the carrier material 55, wherein, once inserted into a filter element 20, may be irradiated or heated to break down the foam and release the adsorbent material therefrom. Alternately, the carrier material 55 may comprise an open cell foam, wherein, for example, air and/or physical force may be used to release the adsorbent material 50 once the object is inserted into the filter element 20.

In other instances, the carrier material 55 may be provided, for example, in the form of a breakable capsule, a "capsule-in-capsule," or a strand, formed of a water- or other liquid-soluble polymer and configured to carry the adsorbent material 50. Such a soluble polymer may comprise, for example, polylactic acid, polyvinyl alcohol (PVA), starches and/or starch-based polymers, carrageenans, polyvinyl acetate, hydroxypropylcellulose, pullulan, carboxymethylcellulose and its salts (i.e., alkali metal salts), alginates and their salts, gelatin, and/or any other suitable polymers or combinations thereof. Because the releasable form of the carrier material 55 causes the dispersion of the adsorbent material, thereby allowing the mainstream smoke to pass through the filter element and interact with the adsorbent material, the object can be relatively larger than previous "solid state" objects inserted into filter elements (i.e., relatively larger than between about 2 mm and about 3.5 mm).

In controlling this process, a control system may include appropriate control hardware and/or software. An exemplary control system 290 can incorporate, for example, a Siemens 315-2DP Processor, a Siemens FM352-5 Boolean Processor and a 16 input bit/16 output bit module. Such a system can utilize a system display 293, such as a Siemens MP370 display. An exemplary rod-making unit 212 may include controls configured, for a rod of desired length, to adjust the speed of the knife of the severing unit to be timed relative to the speed of continuous rod formation. In such instances, a first encoder 296, by way of connection with the drive belt of the rod-making unit, and the control unit 299 of the insertion unit, may provide a reference of the knife position of the cutting assembly relative to the wheel position of the insertion unit. Thus, the first encoder 296 may provide one manner of controlling the speed of rotation of the wheel of the insertion unit relative to the speed at which continuous web of filter tow passes through the rod-making unit. An exemplary first encoder 296 is available as a Heidenhain Absolute 2048 encoder.

In one embodiment of the invention, the adsorbent material 50 and the carrier material 55 are both in the form of a fiber, with the adsorbent material fiber comprising or incorporating an adsorbent material as defined herein. The fibers can comprise conventional staple fiber as well as substantially continuous structures, such as continuous filaments. The fibers of the invention can be hollow or solid, and can have a substantially round or circular cross section or non-circular cross sections (e.g., oval, square, rectangular, multi-lobed, and the like). The fibers can be in the form of a single thread or filament or in the form of a multiple thread or filament structure, such as in the form of a yarn or other structure wherein multiple filaments are bonded, twisted, or entangled together. Where the fibers are twisted, bonded, or entangled together, the fibers can be adapted for unraveling after insertion into a filter so as to increase the available surface area of the adsorbent fiber. The fibers can be formed by any fiber-forming process known in the art, including extrusion, melt-spinning, solution spinning, and the like. The color of each fiber can vary, but the adsorbent fiber will often appear black where the adsorbent fiber is a carbonaceous fiber as described herein.

The fibers used for the adsorbent material 50 or the carrier material 55 can be constructed of natural or synthetic materials. Exemplary natural fibers include cotton, linen, jute, hemp, cotton, wool, and wood pulp. Exemplary synthetic polymers that can be used to form the fibers include polyamides, polyamines, polyimides, polyacrylics, polycarbonates, polydienes, polyepoxides, polyesters, polyethers, polyfluorocarbons, polyolefins, polyphenylenes, silicon containing polymers, polyurethanes, polyvinyls, polyacetals, polyarylates, modified cellulosic fibers (e.g., cellulose acetate), copolymers thereof, terpolymers thereof, and mixtures thereof. Non-limiting examples of specific polymeric materials useful as the fiber material according to the present invention include the following: Nylon 6, Nylon 6/6, Nylon 12, polyaspartic acid, polyglutamic acid, polyacrylamide, polyacrylonitrile, esters of methacrylic acid and acrylic acid, polybisphenol A carbonate, polypropylene carbonate, polybutadiene, polyisoprene, polynorbonene, polyethylene terephthalate, polybutylene terephthalate, polytrimethylene terephthalate, polycaprolactone, polyglycolide, polylactide, polyhydroxybutyrate, polyhydroxyvalerate, polyethylene adipate, polybutylene adipate, polypropylene succinate, polyethylene glycol, polybutylene glycol, polypropylene oxide, polyoxymethylene, polytetramethylene ether, polytetrahydrofuran, polyepichlorohydrin, urea-formaldehyde, melamine-formaldehyde, phenol formaldehyde, polyethylene, polypropylene, polybutylene, polybutene, polyoctene, polyphenylene oxide, polyphenylene sulfide, polyether sulfone, polyphenylene ether sulfone, polydimethyl siloxane, polycarbomethyl silane, polyvinyl butyral, polyvinyl alcohol, esters and ethers of polyvinyl alcohol, polyvinyl acetate, polystyrene, polymethylstyrene, polyvinyl chloride, polyvinyl pyrrolidone, polymethyl vinyl ether, polyethyl vinyl ether, polyvinyl methyl ketone, polyethylene-co-vinyl acetate, polyethylene-co-acrylic acid, polybutylene terephthalate-co-polyethylene terephthalate, and polylauryllactam-block-polytetrahydrofuran.

The adsorbent material 50 can be incorporated into the adsorbent fiber in any manner known in the art, including by adhering adsorbent particles to the fiber, by imbedding or suspending adsorbent particles within the fiber, or by forming a fiber and then chemically altering the fiber such that an adsorbent material is formed (e.g., carbonization of a fiber). In one embodiment, the adsorbent fiber is constructed of a carbonaceous material (i.e., a carbon fiber).

Carbon fibers can be described as fibers obtained by the controlled pyrolysis of a precursor fiber. Since carbon is typically difficult to shape into fiber form, commercial carbon fibers are often made by extrusion of a precursor material into filaments, which is followed by carbonization, usually at high temperature. Common precursors for carbon fibers include rayon, acrylic fibers (such as polyacrylonitrile or PAN), and pitch (which can include isotropic pitch and anisotropic mesophase pitch, as well as meltblown pitch fibers). Other precursors, such as cellulose, may also be converted to carbon fibers. KYNOL™ novoloid fibers (available from American Kynol, Inc., Pleasantville, N.Y.), are high-performance phenolic fibers that are transformed into activated carbon by a one-step process combining both carbonization and activation. Forming carbon fibers from rayon or acrylics generally consists of stabilization, carbonization, and graphitization, each taking place at successively higher temperatures, to sufficiently remove non-carbon species, such as oxygen, nitrogen, and hydrogen. Preparation of fibers using pitch also typically includes stabilization and carbonization; however, pitch is typically spun as part of the carbon fiber forming process, whereas pre-formed fibers from rayon or acrylics can be used directly. Activation can sometimes add yet further production steps. Sources of carbon fibers include Toray Industries, Toho Tenax, Mitsubishi, Sumitomo Corporation, Hexcel Corp., Cytec Industries, Zoltek Companies, and SGL Group.

Carbon fibers are often classified in three separate ways. First, they can be classified based on modulus and strength. Examples include ultra high modulus (UHM) fibers (modulus>450 Gpa); high modulus (HM) fibers (modulus between 350 and 450 Gpa); intermediate modulus (IM) fibers (modulus between 200 and 350 Gpa); low modulus, high tensile (HT) fibers (modulus<100 Gpa and tensile strength>3.0 Gpa); and super high tensile (SHT) fibers (tensile strength>4.5 Gpa). Second, carbon fibers can be classified based on the precursor material used to prepare the fiber (e.g., PAN, rayon, pitch, mesophase pitch, isotropic pitch, or gas phase grown fibers). Third, carbon fibers can be classified based on the final heat treatment temperature. Examples include Type-I, high heat treatment (HTT) fibers (final heat treatment temperature above 2,000° C.), Type-II, intermediate heat treatment (IHT) fibers (final heat treatment temperature around 1,500° C.), and Type-III low heat treatment (LHT) fibers (final heat treatment not greater than 1,000° C.). Any of the above classifications of carbon fibers could be used in the present invention.

Examples of starting materials, methods of preparing carbon-containing fibers, and types of carbon-containing fibers are disclosed in U.S. Pat. No. 3,319,629 to Chamberlain; U.S. Pat. No. 3,413,982 to Sublett et al.; U.S. Pat. No. 3,904,577 to Buisson; U.S. Pat. No. 4,281,671 to Bynre et al.; U.S. Pat. No. 4,876,078 to Arakawa et al.; U.S. Pat. No. 4,947,874 to Brooks et al.; U.S. Pat. No. 5,230,960 to Iizuka; U.S. Pat. No. 5,268,158 to Paul, Jr.; U.S. Pat. No. 5,338,605 to Noland et al.; U.S. Pat. No. 5,446,005 to Endo; U.S. Pat. No. 5,482,773 to Bair; U.S. Pat. No. 5,536,486 to Nagata et al.; U.S. Pat. No. 5,622,190 to Arterbery et al.; and U.S. Pat. No. 7,223,376 to Panter et al.; and U.S. Pat. Publication Nos. 2006/0201524 to Zhang et al. and 2006/0231113 to Newbery et al., all of which are incorporated herein by reference. Disclosure around PAN-based carbon fibers particularly (including manufacturers thereof) is provided in the report to congress entitled "Polyacrylonitrile (PAN) Carbon Fibers Industrial Capability Assessment: OUSD(AT&L) Industrial Policy" (October 2005), available on-line at http://www.acq.osd.mil/ip/docs/pan_carbon_fiber_report_to_congress__10-2005.pdf, which is incorporated herein by reference.

The size of the carrier fiber and the adsorbent fiber (e.g., the carbon fiber) can vary without departing from the invention. Typically, fiber sizes vary from about 0.5 denier to about 20 denier. The size of the adsorbent fiber will often depend, at least in part, on the desired amount of adsorbent in the filter element. For example, the size of the adsorbent fiber can be determined based on the desired weight of adsorbent in the filter, such as the weight ranges for carbonaceous materials set forth herein.

The carrier fiber and the adsorbent fiber (e.g., the carbon fiber) can be connected or associated with each other for purposes of insertion into a cigarette filter material using any of a variety of methods, including wrapping, intertwining or weaving the two fiber types together, bonding the fiber types together using an adhesive or binder, co-extruding the fibers, or tying the fiber types together using a separate connecting element, such as a separate thread or clip. Each composite fiber structure (i.e., combination of a carrier fiber and an adsorbent fiber) can include one or multiple fibers of each type, meaning each fiber structure can include, for example, 1 to about 20 carrier fibers and 1 to about 20 adsorbent fibers.

In another embodiment of the invention, the filter material incorporates a fiber material that is degradable, meaning the fiber is capable of undergoing degradation or decomposition, for example through chemical reaction that breaks down the fiber into decomposition products, under environmental conditions associated with disposal of the fiber material. One exemplary type of degradation is biodegradation. As used herein, the term "biodegradable fiber" refers to a polymeric fiber material that degrades under aerobic and/or anaerobic conditions in the presence of bacteria, fungi, algae, and other microorganisms to carbon dioxide/methane, water and biomass, although materials containing heteroatoms can also yield other products such as ammonia or sulfur dioxide. "Biomass" generally refers to the portion of the metabolized materials incorporated into the cellular structure of the organisms present or converted to humus fractions indistinguishable from material of biological origin. Exemplary biodegradable fibers include, without limitation, cellulosic or other organic plant-derived fibers (e.g., cotton, wool, cedar, hemp, bamboo, kapok, or flax), polyvinyl alcohol, aliphatic polyesters, aliphatic polyurethanes, cis-polyisoprene, cis-polybutadiene, polyhydroxy alkanoates, polyanhydrides, and copolymers and blends thereof. The term "aliphatic polyester" refers to polymers having the structure $—[C(O)—R—O]_n—$, wherein n is an integer representing the number of monomer units in the polymer chain and R is an aliphatic hydrocarbon, preferably a C1-C10 alkylene, more preferably a C1-C6 alkylene (e.g., methylene, ethylene, propylene, isopropylene, butylene, isobutylene, and the like), wherein the alkylene group can be a straight chain or branched. Exemplary aliphatic polyesters include polyglycolic acid (PGA), polylactic acid (PLA) (e.g., poly(L-lactic acid) or poly(DL-lactic acid)), polyhydroxy butyrate (PHB), polyhydroxy valerate (PHV), polycaprolactone (PCL), and copolymers thereof.

In certain embodiments, the biodegradable fiber is a bamboo fiber or a PLA fiber. Suitable bamboo fibers are described, for example, in U.S. Pat. No. 7,313,906 to Zhou et al., which is incorporated by reference herein. Bamboo fibers are commercially available from China Bambro Textile Co., Ltd. PLA fibers can be derived from corn or made synthetically. Suitable PLA fibers are described in U.S. Pat. No. 7,445,841 to Kaijiyama et al., which is incorporated by reference herein, and are commercially available from NatureWorks LLC.

The degradable fiber can be utilized in the form of a single strand or as part of a multi-strand yarn structure. In certain embodiments, the fibrous material can be used in the form of a sheet. The degradable fiber can be used in combinations containing multiple fiber types, such as degradable fiber materials of different types woven together or otherwise combined into a unitary structure or combinations of degradable fibers with non-degradable fibers and/or adsorbent fibers woven together or otherwise combined into a unitary structure (e.g., combining bamboo fibers, cotton fibers, and carbon fibers into a single fiber structure such as a single yarn structure). Alternatively, multiple fiber types could be combined or mixed within a single fiber strand.

Where the fiber is described as comprising a particular type of fiber material, the fiber often will be comprised primarily of the given fiber material (e.g., above about 50% by weight based on the total weight of the fiber) or consist essentially of the fiber material (e.g., above about 90% by weight) or consist virtually entirely of the fiber material (e.g., above about 98% by weight or about 100% by weight). For example, a fiber described as a "bamboo fiber" can incorporate relatively minor amounts of bamboo fibrous material (e.g., in combination with other types of fibrous materials or in combination with additives), or be comprised primarily of bamboo fibrous material, or consist essentially of bamboo fibrous material, or consist virtually entirely of bamboo fibrous material.

The degradable fibers can act as a carrier fiber for an adsorbent material (e.g., a carbon fiber) as described herein, or as a carrier for other additives adapted to alter the flavor or aroma of a smoking article, or as a carrier for both an adsorbent material and a flavor/aroma additive. Alternatively, the inherent properties of the degradable fiber itself may alter the character or nature of the smoke passing through the filter. Exemplary flavoring agents or aroma agents include any solid or liquid composition that can be incorporated into a fiber structure by, for example, absorption, adhesion, or physical entanglement within a fibrous structure. The additives can be any composition capable of altering the character or nature of the smoke passing through the filter material, such as by action of a flavorant or a deodorizing agent. Exemplary additives include natural or synthetic flavorants that can alter the flavor and/or aroma of mainstream smoke, and the character of the flavors imparted thereby may be described, without limitation, as fresh, sweet, herbal, confectionary, floral, fruity or spice. Specific types of flavors or aromas include, but are not limited to, vanilla, coffee, chocolate/cocoa, cream, mint, spearmint, menthol, peppermint, wintergreen, eucalyptus, lavender, cardamon, nutmeg, cinnamon, clove, cascarilla, sandalwood, honey, jasmine, ginger, anise, sage, licorice, lemon, orange, apple, peach, lime, cherry, strawberry, and any combinations thereof. See also, Leffingwell et al., *Tobacco Flavoring for Smoking Products*, R. J. Reynolds Tobacco Company (1972), which is incorporated herein by reference. Flavorings also may include components that are considered moistening, cooling or smoothening agents, such as eucalyptus. These flavors may be provided neat (i.e., alone) or in a composite (e.g., spearmint and menthol, or orange and cinnamon). Exemplary deodorizing agents include any composition adapted to mask or remove tobacco smoke aroma. One exemplary composition comprises inorganic salts and odor adsorbents such as described in U.S. Pat. No. 7,407,922 to Leskowitz, which is incorporated by reference herein. Another deodorizing composition contains a mandarin orange essential oil fraction such as described in U.S. Pat. No. 7,434,586 to Higashi et al., which is also incorporated by reference herein.

The degradable fiber can be incorporated into a filter material in the same manner as described herein for the carrier fiber/adsorbent material embodiments. For example, the degradable fiber could be utilized as the carrier fiber in the composite fiber structures set forth in FIGS. 5 and 6. Alternatively, the degradable fiber can be imbedded in a filter material without a second fiber structure. For example, a degradable fiber comprising a flavoring agent could be added to a filter material. In yet another embodiment, the degradable fiber, with or without additives as described herein, can be incorporated into any of the wrapping materials utilized in a smoking article filter, such as in the plug wrap or tipping material.

In another embodiment, the degradable fiber can be replaced with a non-degradable fiber, such as any of the numerous synthetic fiber materials described herein that are not typically viewed as degradable in nature (e.g., polyethylene terephthalate or polypropylene). The non-degradable fiber can be used in any of the applications described herein for degradable fibers. Both the degradable fibers and the non-degradable fibers can be derived from natural materials, synthetic materials, or materials of a natural origin that have been chemically modified.

The number of degradable or non-degradable fibers imbedded within a filter element can vary. Typical ranges of the number of fiber insertions within a filter element segment include 1 to about 500 fiber insertions, more typically 1 to about 100, and often 1 to about 50.

Figure 5:
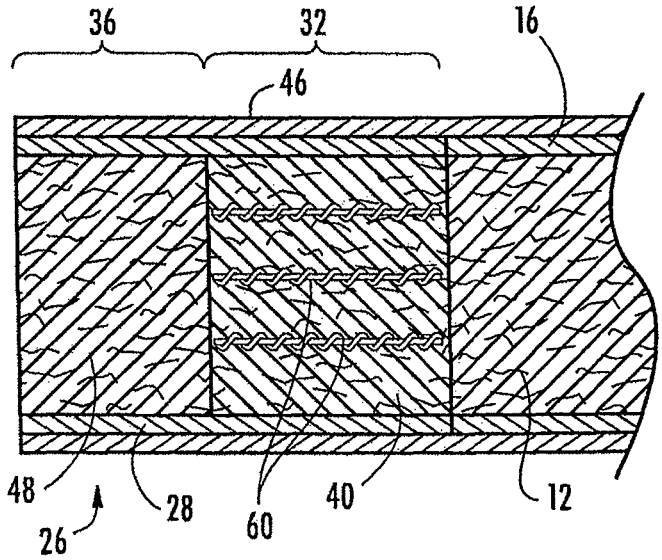
FIG. 5 is a cross-sectional view of a filter element incorporating a carbonaceous fiber carried by a carrier fiber.
Figure 6:
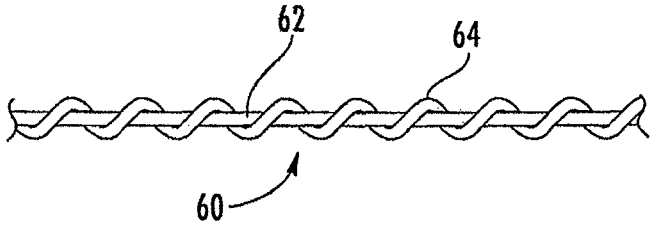
FIG. 6 is a perspective view of a carbonaceous fiber carried by a carrier fiber.

FIG. 5 illustrates one example of a composite fiber structure 60 imbedded within a filter segment 32. Although multiple composite fiber structures 60 are set forth in FIG. 5, the number of composite fiber structures can vary. An exemplary range of the number of composite fiber structures 60 incorporated into a filter 26 is 1 to about 500, more typically 1 to about 100, and often 1 to about 50. The composite fiber structures 60 can be included in a single segment 32 of a multi-segment filter 26 as shown in FIG. 5, or the composite fiber structures can be imbedded within a filter element comprising only a single segment or can extend throughout multiple sections of a multi-segment filter. The composite fiber structures 60 can extend linearly in the longitudinal direction of the cigarette filter as shown in FIG. 5, or can extend transverse to the longitudinal axis of the filter element or can be randomly dispersed at various angles throughout the filter segment. As shown in FIG. 6, the composite fiber structure 60 can include at least one carrier fiber 62 and at least one adsorbent fiber 64.

As shown in FIGS. 5 and 6, one method of connecting the two fiber types is to wrap the adsorbent fiber 64 around the carrier fiber 62. The number of wraps of the adsorbent fiber 64 per unit of length of the carrier fiber 62 can vary, and will depend on a number of factors including the desired amount of adsorbent material in the filter element. An exemplary range of wrappings of the adsorbent fiber 64 around the carrier fiber 62 is 1 to about 50 circumferential wrappings of the adsorbent fiber per inch of carrier fiber.

Many modifications and other embodiments of the invention will come to mind to one skilled in the art to which this invention pertains having the benefit of the teachings presented in the foregoing description; and it will be apparent to those skilled in the art that variations and modifications of the present invention can be made without departing from the scope or spirit of the invention. Therefore, it is to be understood that the invention is not to be limited to the specific embodiments disclosed and that modifications and other embodiments are intended to be included within the scope of the appended claims. Although specific terms are employed herein, they are used in a generic and descriptive sense only and not for purposes of limitation.

What is claimed is:

1. A cigarette filter comprising at least one filter segment having at least one composite fiber structure imbedded therein, the composite fiber structure comprising two different fiber types comprising a degradable fiber and a second fiber capable of altering the flavor or aroma of mainstream smoke, wherein the two fibers are connected together to enable co-insertion of the composite fiber structure into the filter segment.

2. The cigarette filter of claim 1, wherein the second fiber comprises an additive selected from the group consisting of adsorbent materials, flavorants, deodorizing agents, and combinations thereof.

3. The cigarette filter of claim 1, wherein the second fiber is a carbonaceous fiber.

4. The cigarette filter of claim 3, wherein the carbonaceous fiber is prepared by carbonization of a precursor fiber.

5. The cigarette filter of claim 4, wherein the precursor fiber is selected from the group consisting of phenolic fibers, cellulosic fibers, rayon fibers, acrylic fibers, and pitch fibers.

6. The cigarette filter of claim 3, wherein the carbonaceous fiber is wrapped around the degradable fiber.

7. The cigarette filter of claim 1, wherein the degradable fiber is a biodegradable fiber selected from the group consisting of cellulosic fibers, polyvinyl alcohol, aliphatic polyesters, aliphatic polyurethanes, cis-polyisoprene, cis-polybutadiene, polyhydroxy alkanoates, polyanhydrides, and copolymers and blends thereof.

8. The cigarette filter of claim 1, wherein the degradable fiber is a bamboo fiber or a polylactic acid fiber.

9. The cigarette filter of claim 1, wherein the filter comprises one or more segments of fibrous tow material, and the composite fiber structure is imbedded in the fibrous tow material.

10. The cigarette filter of claim 9, wherein the fibrous tow material is a cellulose acetate tow.

11. A smoking article comprising a rod of smokable material circumscribed by a wrapping material, the rod of smokable material being attached to a cigarette filter according to claim 1.

12. The cigarette filter of claim 1, wherein the second fiber capable of altering the flavor or aroma of mainstream smoke comprises an adsorbent fiber.

13. The cigarette filter of claim 1, wherein the degradable fiber and the second fiber are connected together by wrapping the fibers, intertwining or weaving the fibers, bonding the fibers together using an adhesive or binder, co-extruding the fibers, or tying the fibers together using a separate connecting element.

14. A cigarette filter comprising at least one filter segment having at least one composite fiber structure imbedded therein, the composite fiber structure comprising two different fiber types comprising a biodegradable fiber and a second fiber capable of altering the flavor or aroma of mainstream smoke, wherein the two fibers are of different types and are connected together to enable co-insertion of the composite fiber structure into the filter segment, wherein the biodegradable fiber is a bamboo fiber or a polylactic acid fiber.

15. The cigarette filter of claim 14, wherein the second fiber is a carbonaceous fiber.

16. A smoking article comprising a rod of smokable material circumscribed by a wrapping material, the rod of smokable material being attached to a cigarette filter according to claim 14.

17. The cigarette filter of claim 14, wherein the second fiber capable of altering the flavor or aroma of mainstream smoke comprises an adsorbent fiber.

18. The cigarette filter of claim 14, wherein the second fiber comprises an additive, selected from the group consisting of adsorbent materials, flavorants, deodorizing agents, and combinations thereof.

19. The cigarette filter of claim 14, wherein the biodegradable fiber and the second fiber are connected together by wrapping the fibers, intertwining or weaving the fibers, bonding the fibers together using an adhesive or binder, co-extruding the fibers, or tying the fibers together using a separate connecting element.

* * * * *